US005942381A

United States Patent [19]

Merkel et al.

[11] Patent Number: 5,942,381

[45] **Date of Patent: *Aug. 24, 1999**

[54] PHOTOGRAPHIC ELEMENT AND PROCESS EMPLOYING ACTIVE, STABLE BENZOTRIAZOLE-RELEASING DIR COUPLERS

[75] Inventors: Paul B. Merkel, Victor; Ronald E. Leone; Jerrold N. Poslusny, both of Rochester, all of N.Y.

[73] Assignee: Eastman Kodak Company, Rochester, N.Y.

[ * ] Notice: This patent is subject to a terminal disclaimer.

[21] Appl. No.: 08/873,516

[22] Filed: Jun. 12, 1997

[51] Int. Cl.[6] ..... G03C 1/08; G03C 7/26; G03C 7/32

[52] U.S. Cl. ..... 430/544; 430/505; 430/554; 430/555; 430/957; 430/549

[58] Field of Search ..... 430/505, 544, 430/554, 555, 957, 549

[56] References Cited

U.S. PATENT DOCUMENTS

| | | | |
|---|---|---|---|
| 5,411,841 | 5/1995 | Singer et al. | 430/555 |
| 5,447,830 | 9/1995 | Pawlak et al. | 430/555 |
| 5,462,848 | 10/1995 | Merkel et al. | 430/555 |
| 5,605,787 | 2/1997 | Pawlak et al. | 430/555 |
| 5,663,040 | 9/1997 | Bertoldi et al. | 430/555 |
| 5,677,118 | 10/1997 | Spara et al. | 430/555 |

*Primary Examiner*—Geraldine Letscher
*Attorney, Agent, or Firm*—Arthur E. Kluegel

[57] ABSTRACT

A photographic element comprising a silver halide emulsion layer having associated therewith a 1-phenyl-3-anilino-4-benzotriazolyl-5-pyrazolone magenta dye-forming DIR coupler of structure I:

I wherein:

$R_1$ is hydrogen, chlorine, fluorine or a methyl group;

$R_2$, $R_3$, and $R_4$ are individually selected from the group consisting of hydrogen, halogen, alkyl, phenyl, alkoxy, phenoxy, alkylthio, carbonamido, sulfonamido, carbamoyl, alkoxycarbonyl and aryloxycarbonyl groups;

$R_5$ is hydrogen, bromine, chlorine, fluorine, or an alkyl group;

$R_6$ and $R_7$ are independently selected from the group consisting of hydrogen, halogen, carbonamido, carbamoyl, sulfonamido, sulfamoyl, alkylsulfonyl, arylsulfonyl, alkylsulfoxyl, arylsulfoxyl, sulfonyloxy, alkoxycarbonyl, aryloxycarbonyl, acyloxy, acyl, imido, trifluoromethyl and cyano groups, provided that at least one of $R_6$ and $R_7$ is not hydrogen;

$R_8$ and $R_9$ are independently selected from the group consisting of hydrogen, halogen, alkyl, phenyl, alkoxy, phenoxy, alkoxycarbonyl, aryloxycarbonyl, carbonamido sulfonamido, carbamoyl and carbamoyloxy groups, provided that at least one of $R_8$ and $R_9$ is not hydrogen;

further provided that (1) when $R_5$ is hydrogen, the sum of the Hammett's sigma values of $R_6$ and $R_7$, referenced to the position of the anilino nitrogen, is at least 0.30, and $R_1$ is also hydrogen, and (2) when $R_5$ is bromine, chlorine, fluorine, or an lakyl group, the sum of the Hammett sigma values of $R_6$ and $R_7$, referenced to the position of the anilino nitrogen, is a least 0.20; and the sum of pi values of $R_8$ and $R_9$ taken together is at least 0.60 but not more than 3.00.

16 Claims, No Drawings

PHOTOGRAPHIC ELEMENT AND PROCESS EMPLOYING ACTIVE, STABLE BENZOTRIAZOLE-RELEASING DIR COUPLERS

FIELD OF THE INVENTION

This invention relates to a photographic element and process comprising a silver halide emulsion layer having associated therewith a certain magenta benzotriazole-releasing DIR coupler.

BACKGROUND OF THE INVENTION

Many photographic materials, particularly color negative films, contain so-called DIR (development inhibitor releasing) couplers. In addition to forming imaging dye, DIR couplers release inhibitors that can restrain silver development in the layer in which release occurs as well as in other layers of a multilayer photographic material. DIR couplers can help control gamma or contrast, can enhance sharpness or acutance, can reduce granularity and can provide color correction via interlayer interimage effects. There has been a need for more effective magenta dye-forming DIR couplers. Magenta DIR couplers that provide high interimage color correction are particularly desirable for modem color negative films. In addition, it is desirable that such couplers have high activity to maximize rates and efficiencies of inhibitor release and to minimize laydowns. It is also desirable that the magenta DIR couplers be stable toward long term storage particularly at elevated temperatures. The DIR couplers of this invention possess all of these desirable properties, particularly higher activity and greater stability than analogous magenta-dye forming DIR couplers of the prior art.

There are known pyrazolone couplers that contain an unsubstituted benzotriazole coupling-off group, which is outside the scope of the $R_8$ and $R_9$ substituents of this invention. U.S. Pat. No. 4,015,988 lists pyrazolone couplers (9 & 10) with methyl or bromo substituents. However, both couplers have o-methoxy substituents on the anilino group, which is outside the scope of the anilino substituents of this invention. JP60 128,444 discloses a coupler with a dimethyl-substituted benzotriazole, but this coupler also has an o-methoxy substituent on the anilino group.

Many of the prior art couplers, such as those in GB 1,455,967, have a p-nitro substituent on the 1-phenyl group that is outside the scope of the substituents of this invention. U.S. Pat. No. 4,477,563 deals generally with couplers, such as pyrazolone couplers, having benzotriazole leaving groups, but the exemplified couplers contain 2,4,6-trichloro substitution on the 1-phenyl ring or otherwise contain substituents which do not provide the desired improvement in reactivity.

A problem to be solved is to provide a photographic element comprising a silver halide emeulsion layer having associated therewith a magenta dye-forming coupler that has good reactivity and good raw stock keeping.

SUMMARY OF THE INVENTION

The invention provides a photographic element comprising a silver halide emulsion layer having associated therewith a 1-phenyl-3-anilino-4-benzotriazolyl-5-pyrazolone magenta dye-forming DIR coupler of structure I:

I

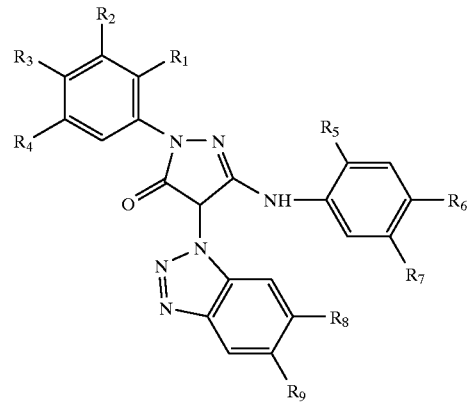

wherein:

$R_1$ is hydrogen, chlorine, fluorine or a methyl group;

$R_2$, $R_3$, and $R_4$ are individually selected from the group consisting of hydrogen, halogen, alkyl, phenyl, alkoxy, phenoxy, alkylthio, carbonamido, sulfonamido, carbamoyl, alkoxycarbonyl and aryloxycarbonyl groups;

$R_5$ is hydrogen, bromine, chlorine, fluorine, or an alkyl group;

$R_6$ and $R_7$ are independently selected from the group consisting of hydrogen, halogen, carbonamido, carbamoyl, sulfonamido, sulfamoyl, alkylsulfonyl, arylsulfonyl, alkylsulfoxyl, arylsulfoxyl, sulfonyloxy, alkoxycarbonyl, aryloxycarbonyl, acyloxy, acyl, imido, trifluoromethyl and cyano groups, provided that at least one of $R_6$ and $R_7$ is not hydrogen;

$R_8$ and $R_9$ are independently selected from the group consisting of hydrogen, halogen, alkyl, phenyl, alkoxy, phenoxy, alkoxycarbonyl, aryloxycarbonyl, carbonamido, sulfonamido, carbamoyl and carbamoyloxy groups, provided that at least one of $R_8$ and $R_9$ is not hydrogen;

further provided that (1) when $R_5$ is hydrogen, the sum of the Hammett's sigma values of $R_6$ and $R_7$, referenced to the position of the anilino nitrogen, is at least 0.30, and $R_1$ is also hydrogen, and (2) when $R_5$ is bromine, chlorine, fluorine, or an alkyl group, the sum of the Hammett sigma values of $R_6$ and $R_7$, referenced to the position of the anilino nitrogen, is a least 0.20; and the sum of pi values of $R_8$ and $R_9$ taken together is at least 0.60 but not more than 3.00.

The invention also provides a magenta DIR coupler, a silver halide emulsion containing the coupler, the dye formed by the combination of the coupler with a color developer, an image containing the foregoing dye, and a process of forming an image comprising contacting the element of the invention with a color developer after the element has been imagewise exposed to light.

The element of the invention provides a magenta dye-forming coupler that has good reactivity and good raw stock keeping.

DETAILED DESCRIPTION OF THE INVENTION

The photographic materials of this invention comprising certain magenta dye-forming pyrazolone DIR couplers are described in the foregoing Summary of the Invention.

It is important to note that the coupler of the invention bears a hydrogen in the 6-position of the N-phenyl ring. This is essential for reactivity as evidenced by the results using C1, C2, and C3 in the photographic examples.

$R_1$ is hydrogen, chlorine, fluorine or a methyl group. For greater coupler reactivity, embodiments wherein $R_1$ is hydrogen are particularly useful. Embodiments wherein $R_1$, $R_2$, and $R_4$ are hydrogen and $R_3$ is hydrogen or methyl are also particularly useful.

$R_2$, $R_3$ and $R_4$ may suitably be individually selected from hydrogen, halogen, alkyl, phenyl, alkoxy, phenoxy, alkylthio, carbonamido, sulfonamido, carbamoyl, alkoxycarbonyl or aryloxycarbonyl groups. Hydrogen, fluoro, chloro, alkyl, alkoxy, carbonamido, and alkoxycarbonyl groups are most typical.

$R_5$ is hydrogen, bromine, chlorine, fluorine or an alkyl group. Embodiments where $R_5$ is chlorine, fluorine, or methyl are suitable examples while chlorine is conveniently employed.

$R_6$ and $R_7$ are independently selected from the group consisting of halogen, carbonamido, carbamoyl, sulfonamido, sulfamoyl, alkylsulfonyl, arylsulfonyl, alkylsulfoxyl, arylsulfoxyl, sulfonyloxy, alkoxycarbonyl, aryloxycarbonyl, acyloxy, acyl, imido, trifluoromethyl and cyano groups. Alkylsulfonyl, alkoxycarbonyl, carbonamido and cyano groups are generally useful, with usually only one of the 4- or 5-position relative to the anilino nitrogen being occupied by a nonhydrogen substituent. At least one of $R_6$ and $R_7$ is a nonhydrogen substituent.

When $R_5$ is hydrogen, the sum of the Hammett sigma values of $R_6$ and $R_7$, referenced to the position of the anilino nitrogen, is at least 0.30, and $R_1$ is also hydrogen. When $R_5$ is chlorine or fluorine, the sum of the Hammett sigma values of $R_6$ and $R_7$, referenced to the position of the anilino nitrogen, is a least 0.20.

$R_8$ and $R_9$ are individually selected from the group consisting of hydrogen, halogen, alkyl, phenyl, alkoxy, phenoxy, alkoxycarbonyl, aryloxycarbonyl, carbonamido (including but not limited to alkyl-, aryl-, alkoxy- and aryloxycarbonamido), sulfonamido, carbamoyl and carbamoyloxy groups. Phenoxycarbonyl and derivatives are suitably used such as p-chlorophenoxycarbonyl, p-methylphenoxycarbonyl or p-methylthiophenoxycarbonyl, as well as alkoxy, carbonamido, and alkoxycarbonyl substituents. Other examples are butoxycarbonylmethoxycarbonyl, 1-methyl-1-butoxycarbonylmethoxycarbonyl, n-pentylcarbonylamino, 5,6-dichloro, 5,6-dipropoxy, and n-butyl. It is necessary that at least one of $R_8$ and $R_9$ is not hydrogen.

The sum of pi values of $R_8$ and $R_9$ taken together is at least 0.60 but not more than 3.00.

Stability may be improved when $R_5$ is chlorine or fluorine and the sum of the Hammett sigma values of $R_6$ and $R_7$ taken together is at least 0.25. In one embodiment, the sum of the pi values of $R_8$ and $R_9$ is from 1.0 to 2.2, which tends to provide efficient development inhibition and good interlayer interimage. In another embodiment, at least one of $R_8$ and $R_9$ is a readily hydrolyzable group, such as a phenoxycarbonyl group or a —$CO_2CH_2CO_2R_{10}$ group, where $R_{10}$ is an alkyl or phenyl group, to prevent seasoning of developer solutions with strong inhibitors. By "readily hydrolyzable group" it is meant that the half life for hydrolysis at 40° C. in a Kodak C-41 developer of the compound to which the group is attached is not more than one hour. To minimize coupler wandering it is also desirable that the total number of carbon atoms plus halogen atoms in $R_1$–$R_7$ taken together be at least 8, and preferably at least 10.

The use of Hammett sigma values and pi values to describe chemical properties is well established in the literature and is discussed, for example, in "Exploring QSAR, Fundamentals and Applications in Chemistry and Biology", C. Hansch and A. Leo, American Chemical Society, Washington, D.C. 1995. There are numerous published sources for Hammett's sigma and for pi values including: "Exploring QSAR, Hydrophobic, Electronic and Steric Constants", C. Hansch, A. Leo and D. Hoekman, American Chemical Society, Washington, D.C., 1995; "The Chemists Companion", A. J. Gorden and R. A. Ford, John Wiley & Sons, New York, 1972; "Substituent Constants for Correlation Analysis", C. Hansch and A. Leo, John Wiley & Sons, New York, 1979; and A. Leo in "Comprehensive Medicinal Chemistry", edited by C. Hansch, P. G. Sammes, and J. B. Taylor, Permagon Press, New York, 1972. Generally, pi values of substituents increase with increasing hydrophobicity and sigma values increase with increasing electron-withdrawing power of the substituent in the vicinity of the point of attachment. Pi and sigma values for hydrogen equal zero.

Useful coated levels of the magenta dye-forming pyrazolone DIR couplers of this invention range from about 0.005 to about 0.40 g/sq m, or more typically from 0.01 to 0.20 g/sq m.

The couplers of this invention are usually utilized by dissolving them in high-boiling coupler solvents and then dispersing the organic coupler plus coupler solvent mixtures as small particles in aqueous solutions of gelatin and surfactant (via milling or homogenization). Removable auxiliary organic solvents such as ethyl acetate or cyclohexanone may also be used in the preparation of such dispersions to facilitate the dissolution of the coupler in the organic phase. Coupler solvents useful for the practice of this invention include, but are not limited to aryl phosphates (e.g. tritolyl phosphate), alkyl phosphates (e.g. trioctyl phosphate), mixed aryl alkyl phosphates (e.g. diphenyl 2-ethylhexyl phosphate), aryl, alkyl or mixed aryl alkyl phosphonates, phosphine oxides (e.g. trioctylphosphine oxide), esters of aromatic acids (e.g. dibutyl phthalate, octyl benzoate, or benzyl salicylate) esters of aliphatic acids (e.g. acetyl tributyl citrate or dibutyl sebecate), alcohols (e.g. 2-hexyl-1-decanol), phenols (e.g. p-dodecylphenol), carbonamides (e.g. N,N-dibutyldodecanamide or N-butylacetanalide), sulfoxides (e.g. bis(2-ethylhexyl)sulfoxide), sulfonamides (e.g. N,N-dibutyl-p-toluenesulfonamide) or hydrocarbons (e.g. dodecylbenzene). Additional coupler solvents and auxiliary solvents are noted in Research Disclosure, December 1989, Item 308,119, p 993. Useful coupler: coupler solvent weight ratios range from about 1:0.1 to 1:8.0, with 1:0.2 to 1:4.0 being preferred.

The pyrazolone DIR couplers of this invention may be used together with a variety of other types of couplers in the same layer or in different layers of a multilayer photographic material. Specifically contemplated is the use of pyrazolone DIR couplers of this invention in green-sensitive photographic elements together with one or more 1-phenyl-3-anilino-5-pyrazolone magenta dye-forming imaging couplers as defined by structures I, III and IV in U.S. Pat. No. 5,200,309 of Merkel and Singer. Such a dye-forming imaging coupler has the formula:

(I)

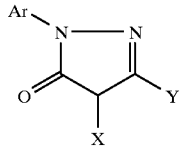

wherein:

Ar is selected from the group consisting of unsubstituted aryl groups, substituted aryl groups and substituted pyridyl groups, the substituents being selected from the group consisting of halogen atoms and cyano, alkylsulfonyl, arylsulfonyl, sulfamoyl, sulfonamido, carbamoyl, carbonamido, alkoxy, acyloxy, aryloxy, alkoxycarbonyl, aryloxycarbonyl, ureido, nitro, alkyl and trifluoromethyl groups;

Y is selected from the group consisting of anilino, acylamino and ureido groups and one of said groups substituted with one or more substituents selected from the group consisting of halogen atoms, and alkyl, aryl, alkoxy, aryloxy, carbonamido, carbamoyl, sulfonamido, sulfamoyl, alkylsulfoxyl, arylsulfoxyl, alkylsulfonyl, arylsulfonyl, alkoxycarbonyl, aryloxycarbonyl, acyl, acyloxy, ureido, imido, carbamate, heterocyclic, cyano, trifluoromethyl, alkylthio, nitro, carboxyl and hydroxyl groups, and groups which form a link to a polymeric chain, and wherein Y contains at least 6 carbon atoms; and X is a coupling-off group selected from the group consisting of halogen atoms, and alkoxy, aryloxy, alkylthio, arylthio, acyloxy, sulfonamido, sulfonyloxy, carbonamido, arylazo, nitrogen-containing heterocyclic and imido groups. Suitably, Y has the formula:

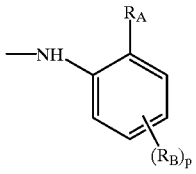

wherein p is from zero to 2 and each $R_B$ is in a meta or para position with respect to $R_A$;

each $R_B$ is individually selected from the group consisting of halogen atoms and alkyl, alkoxy, aryloxy, carbonamido, carbamoyl, sulfonamido, sulfamoyl, alkylsulfoxyl, arylsulfoxyl, alkylsulfonyl, arylsulfonyl, alkoxycarbonyl, aryloxycarbonyl, acyloxy, ureido, imido, carbamate, heterocyclic, cyano, nitro, acyl, trifluoromethyl, alkylthio and carboxyl groups; and $R_A$ is selected from the group consisting of hydrogen, halogen atoms and alkyl, alkoxy, aryloxy, alkylthio, carbonamido, carbamoyl, sulfonamido, sulfamoyl, alkylsulfonyl, arylsulfonyl, alkoxycarbonyl, acyloxy, acyl, cyano, nitro and trifluoromethyl groups.

One useful X has the formula:

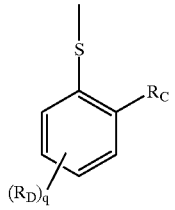

wherein $R_C$ and $R_D$ are individually selected from the group consisting of hydrogen, halogen atoms and alkyl, alkoxy, aryloxy, carbonamido, ureido, carbamate, sulfonamido, carbamoyl, sulfamoyl, acyloxy, alkoxycarbonyl, aryloxycarbonyl, amino and carboxyl groups; and wherein q is 0, 1 or 2 and $R_D$ may be in the meta or para position with respect to the sulfur atom. Particularly contemplated is the use of the pyrazolone DIR couplers of this invention in combination with M-1 and M-2 (see Example 1). Examples of pyrazolone DIR couplers of this invention include, but are not limited to A1–A29, below:

A1

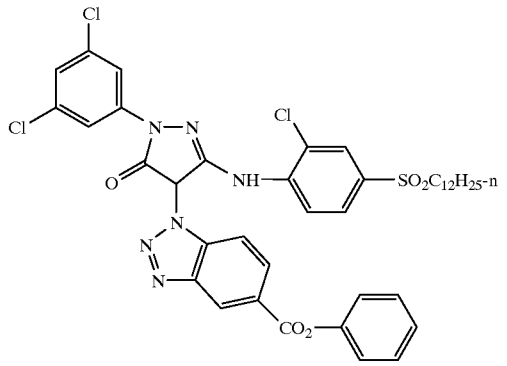

A2

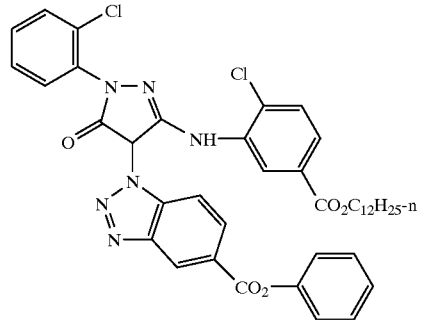

A3

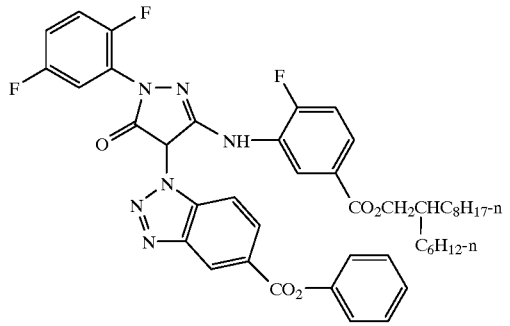

-continued
A4
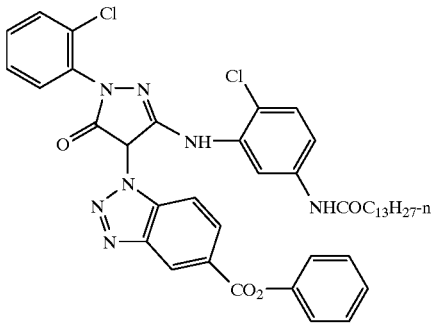
A5
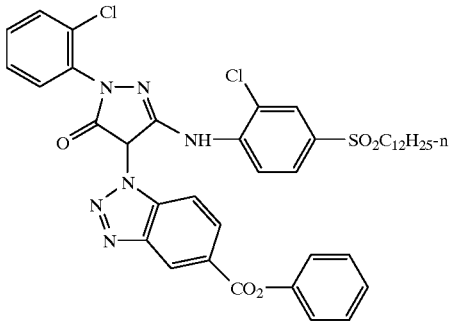
A6
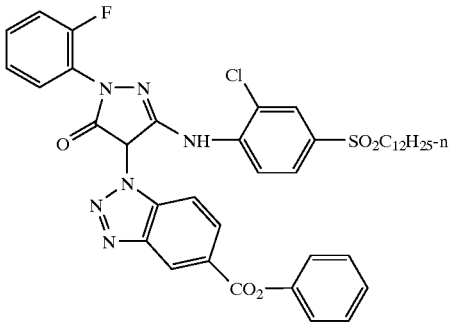
A7
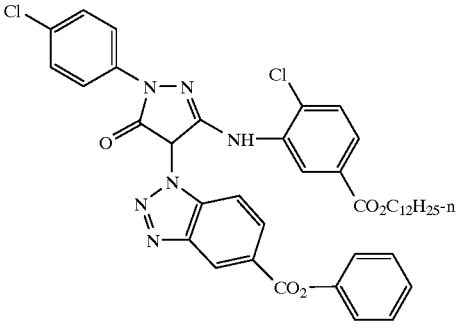
-continued
A8
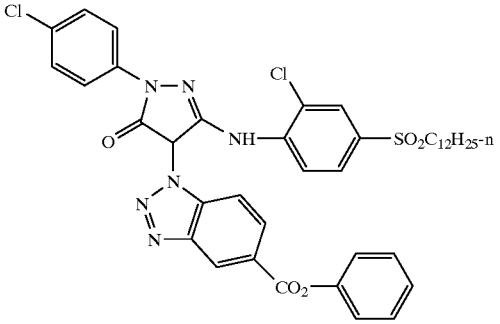
A9
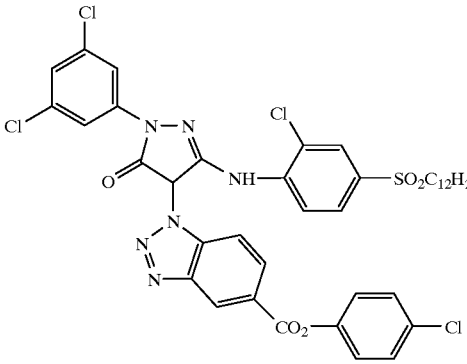
A10
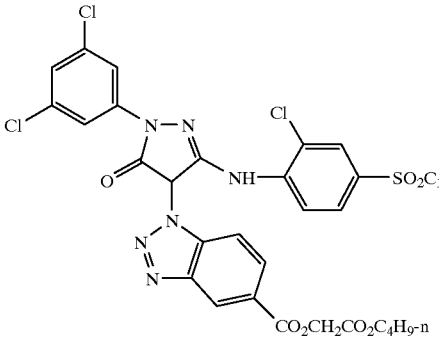
A11
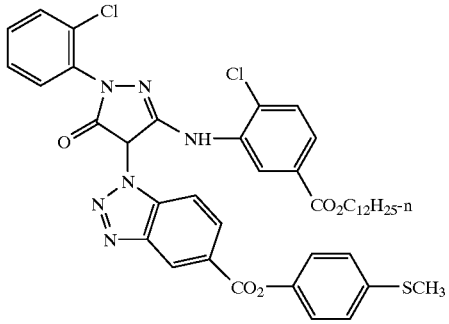

-continued
A12
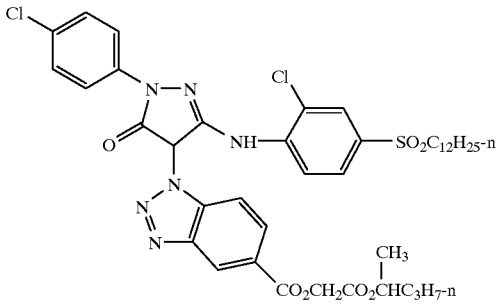
A13
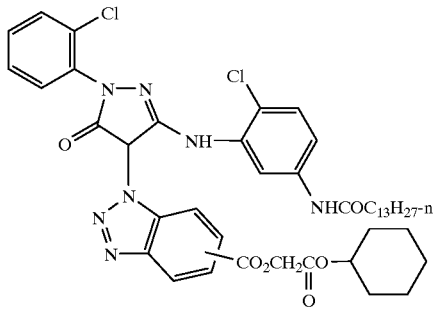
A14
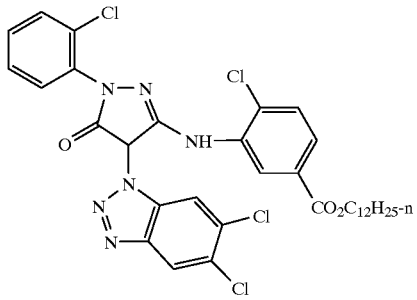
A15
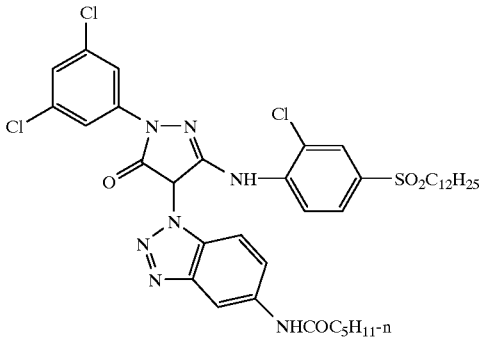
A16
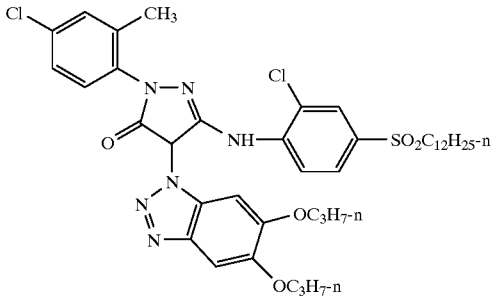
-continued
A17
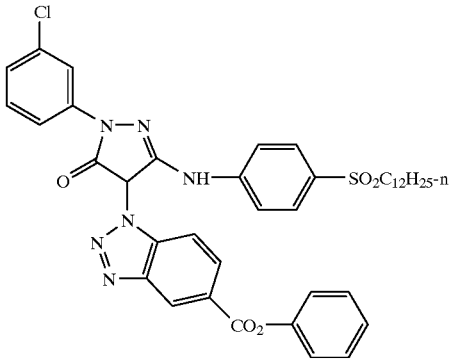
A18
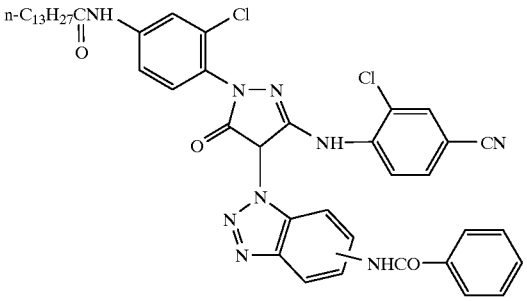
A19
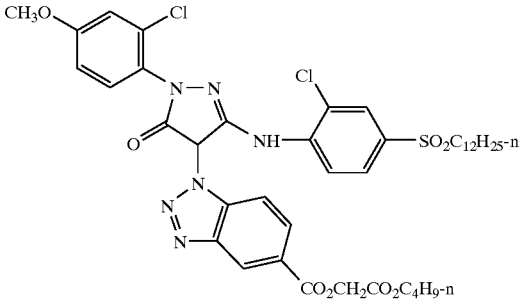
A20
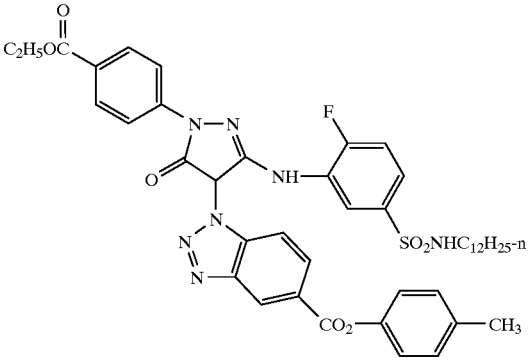

-continued
A21
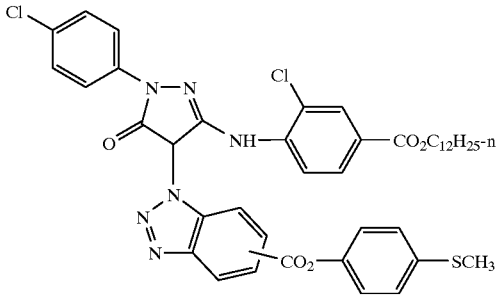
A22
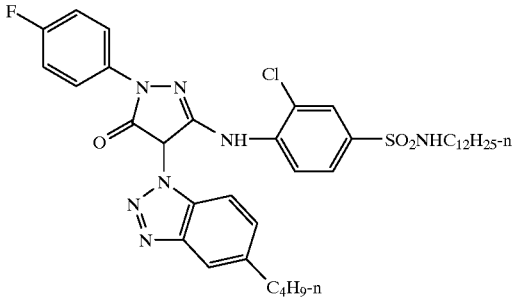
A23
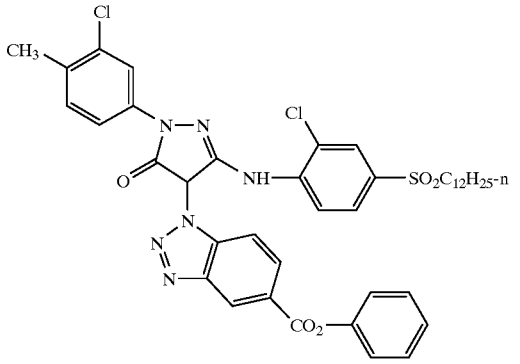
A24
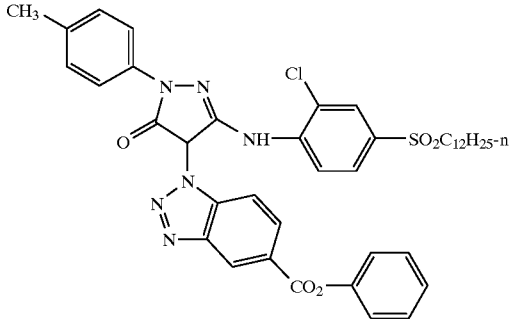
-continued
A25
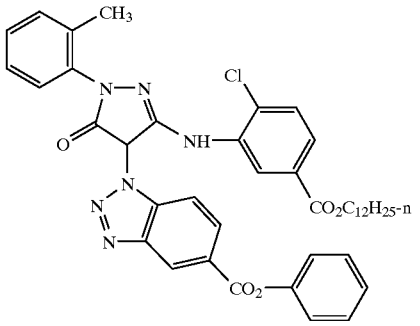
A26
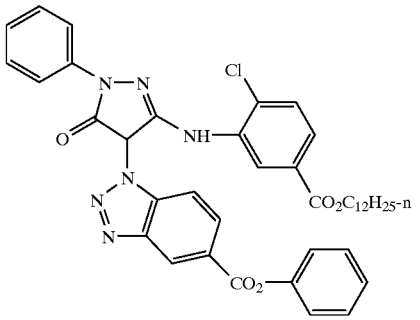
A27
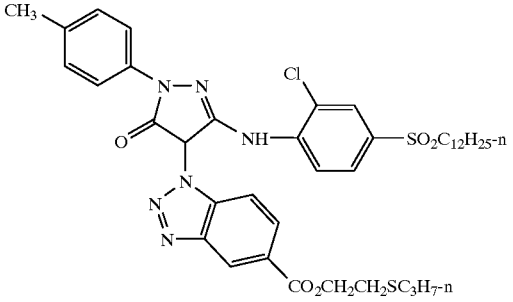
A28
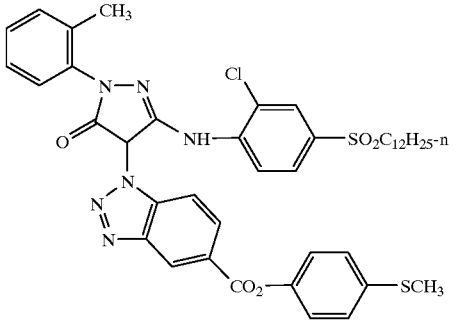

-continued

A29

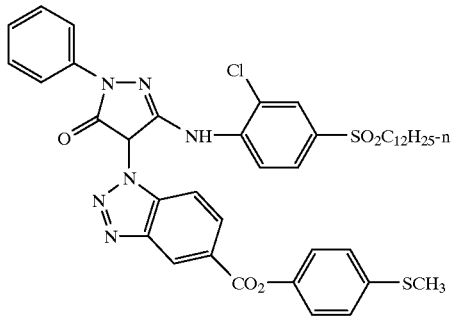

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1-(N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the invention materials are incorporated in a silver halide emulsion and the emulsion coated as a layer on a support to form part of a photographic element. Alternatively, unless provided otherwise, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

To control the migration of various components, it may be desirable to include a high molecular weight hydrophobe or "ballast" group in coupler molecules. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure,* November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, avaliable from the Japanese Patent Office, the contents of which are incorporated herein by reference. When it is desired to employ the inventive materials in a small format film, *Research Disclosure,* June 1994, Item 36230, provides suitable embodiments.

In the following discussion of suitable materials for use in the emulsions and elements of this invention, reference will be made to *Research Disclosure,* September 1996, Item 38957, available as described above, which is referred to herein by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dipersions in organic solvents, are described in Section X(E). Scan facilitating is described in Section XIV. Supports, exposure, development systems, and processing methods and agents are described in Sections XV to XX. The information contained in the September 1994 *Research Disclosure,* Item No. 36544 referenced above, is updated in the September 1996 *Research Disclosure,* Item No. 38957. Certain desirable photographic elements and processing steps, including those useful in conjunction with color reflective prints, are described in *Research Disclosure,* Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkuppler-eine Literature Ubersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, 3,758,309, 4,540,654, and "Farbkuppler-eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine Literature Ubersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: UK. Patent No. 861,138; U.S. Pat.

Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151, 343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

The invention materials may be used in association with materials that release Photographically Useful Groups (PUGS) that accelerate or otherwise modify the processing steps e.g. of bleaching or fixing to improve the quality of the image. Bleach accelerator releasing couplers such as those described in EP 193,389; EP 301,477; U.S. Pat. No. 4,163, 669; U.S. Pat. No. 4,865,956; and U.S. Pat. No. 4,923,784, may be useful. Also contemplated is use of the compositions in association with nucleating agents, development accelerators or their precursors (UK Patent 2,097,140; UK. Patent 2,131,188); electron transfer agents (U.S. Pat. No. 4,859, 578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543, 323.) Also, the compositions may be blocked or coated in protected form as described, for example, in Japanese Application 61/258,249 or U.S. Pat. No. 5,019,492.

The invention materials may further be used in combination with image-modifying compounds that release PUGS such as "Developer Inhibitor-Releasing" compounds (DIR's). DIR's useful in conjunction with the compositions of the invention are known in the art and examples are described in U.S. Pat. Nos. 3,137,578; 3,148,022; 3,148, 062; 3,227,554; 3,384,657; 3,379,529; 3,615,506; 3,617, 291; 3,620,746; 3,701,783; 3,733,201; 4,049,455; 4,095, 984; 4,126,459; 4,149,886; 4,150,228; 4,211,562; 4,248, 962; 4,259,437; 4,362,878; 4,409,323; 4,477,563; 4,782, 012; 4,962,018; 4,500,634; 4,579,816; 4,607,004; 4,618, 571; 4,678,739; 4,746,600; 4,746,601; 4,791,049; 4,857, 447; 4,865,959; 4,880,342; 4,886,736; 4,937,179; 4,946, 767; 4,948,716; 4,952,485; 4,956,269; 4,959,299; 4,966, 835; 4,985,336 as well as in patent publications GB 1,560, 240; GB 2,007,662; GB 2,032,914; GB 2,099,167; DE 2,842,063, DE 2,937,127; DE 3,636,824; DE 3,644,416 as well as the following European Patent Publications: 272, 573; 335,319; 336,411; 346, 899; 362, 870; 365,252; 365, 346; 373,382; 376,212; 377,463; 378,236; 384,670; 396, 486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

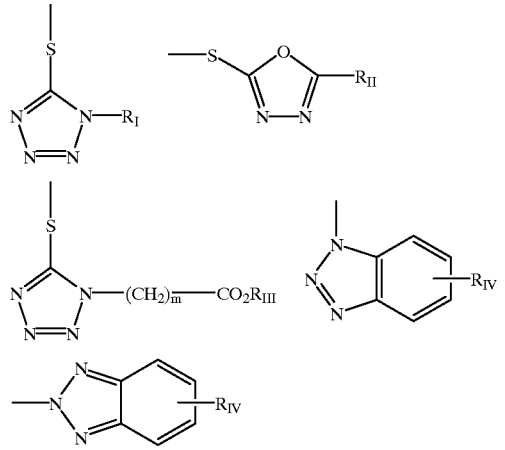

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. No. 4,409,323; 4,421,845; 4,861,701, Japanese Applications 57-188035; 58-98728; 58-209736; 58-209738); groups that function as a coupler or reducing agent after the coupler reaction (U.S. Pat. No. 4,438,193; U.S. Pat. No. 4,618,571) and groups that combine the features describe above. It is typical that the timing group is of one of the formulas:

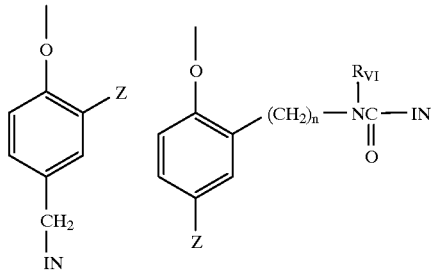

wherein IN is the inhibitor moiety, Z is selected from the group consisting of nitro, cyano, alkylsulfonyl; sulfamoyl ($—SO_2NR_2$); and sulfonamido ($—NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers for use in the present invention include, but are not limited to, the following:

D1

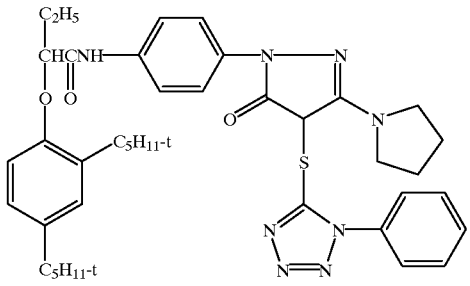

D2

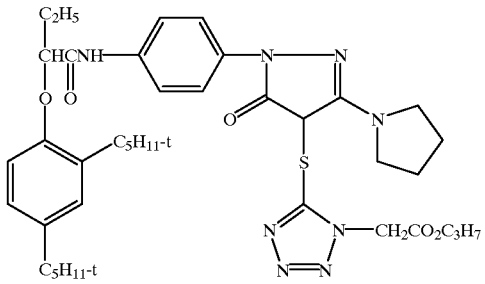

D3

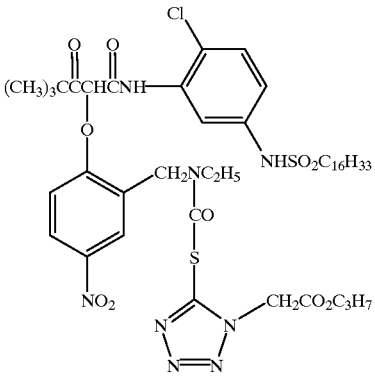

D4

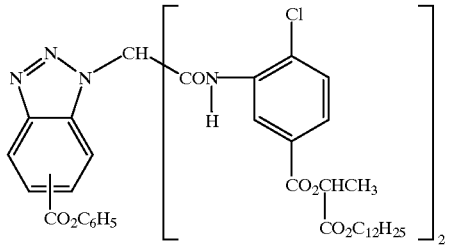

-continued
D5
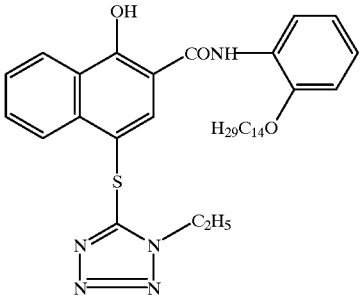
D6
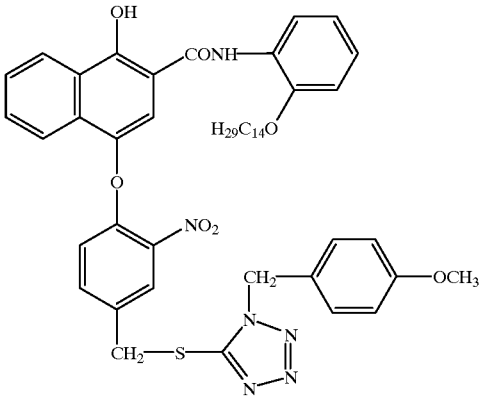
D7
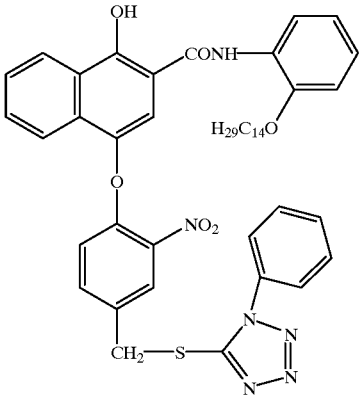
D8
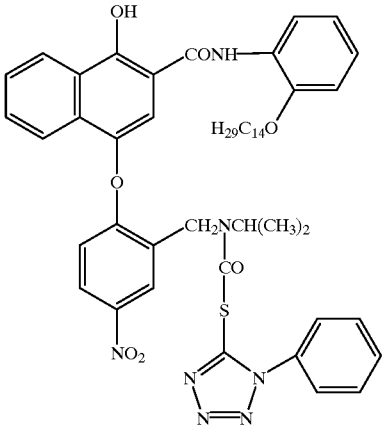
-continued
D9
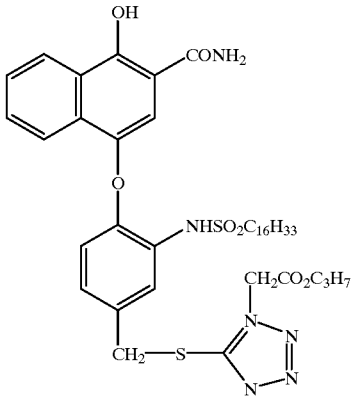
D10
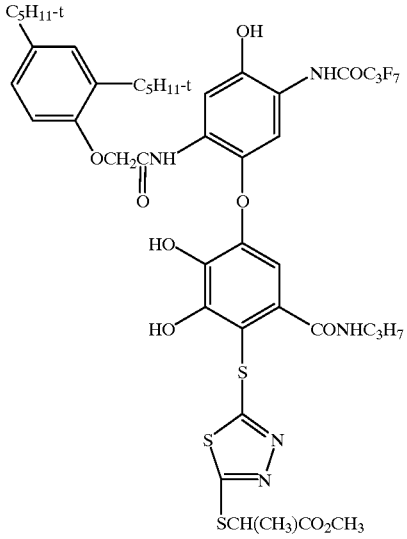
D11
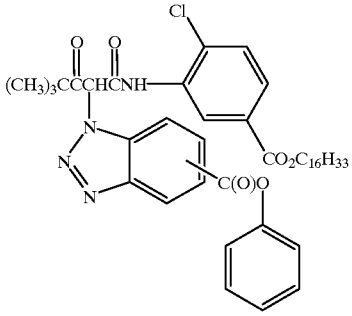

-continued
D12
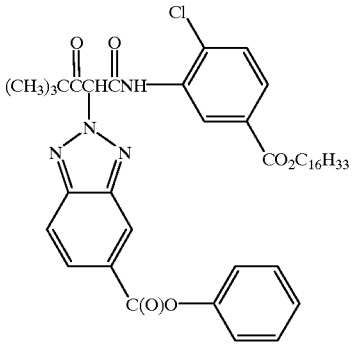
It is also contemplated that the concepts of the present invention may be employed to obtain reflection color prints as described in *Research*
D7
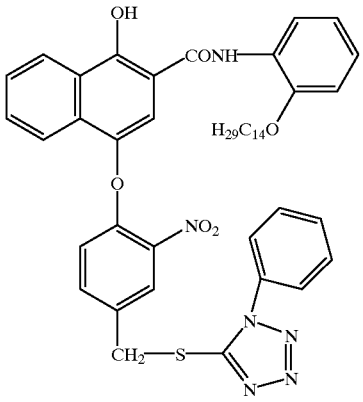
D8
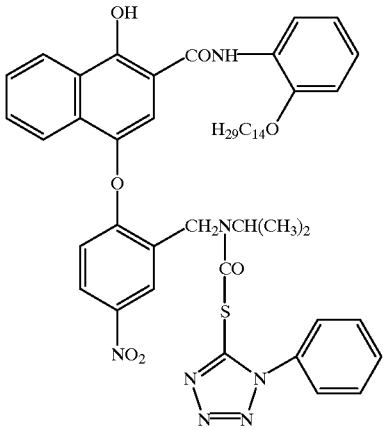
-continued
D9
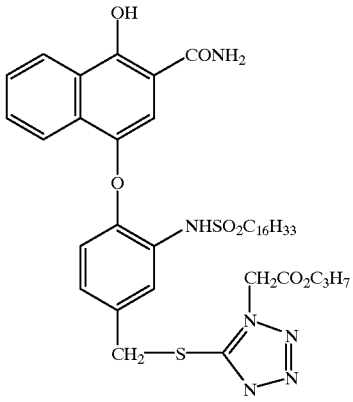
D10
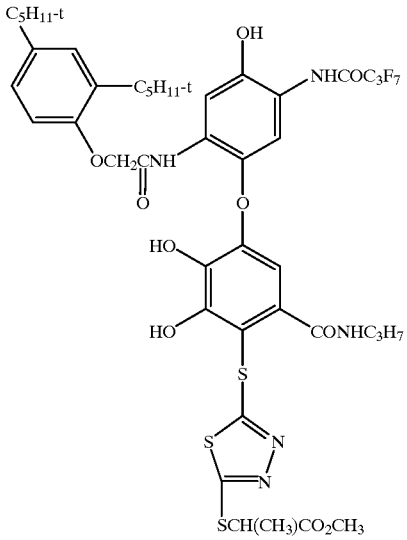
D11
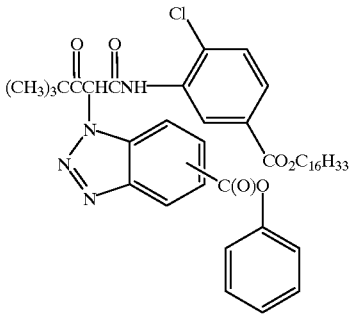

-continued

D12

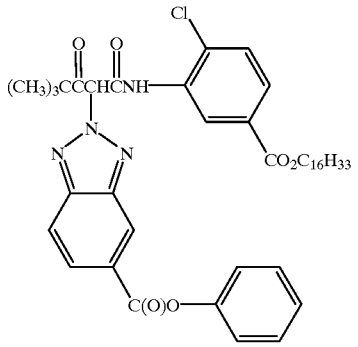

It is also contemplated that the concepts of the present invention may be employed to obtain reflection color prints as described in *Research Disclosure,* November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. No. 4,346,165; U.S. Pat. No. 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09,959.

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 micrometer) tabular grains. To achieve the lowest levels of granularity it is preferred that aim tabular grain projected areas be satisfied with ultrathin (t<0.07 micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. One type of such element, referred to as a color negative film, is designed for image capture. Speed (the sensitivity of the element to low light conditions) is usually critical to obtaining sufficient image in such elements. Such elements may then be processed, for example, in known color negative processes such as the Kodak C-41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual availiable from Eastman Kodak Co. may be employed to provide the color negative image on a transparent support. Color negative development times are typically 3' 15" or less and desirably 90 or even 60 seconds or less.

Elements destined for color reflection prints are provided on a reflective support, typically paper, and may be optically printed using the so-called negative-positive process where the element is exposed to light through a color negative film which has been processed as described above. The print may then be processed to form a positive reflection image using, for example, the Kodak RA-4 process as described in The British Journal of Photography Annual of 1988, Pp 198–199. Color projection prints may be processed, for example, in accordance with the Kodak ECP-2 process as described in the H-24 Manual. Color print development times are typically 90 seconds or less and desirably 45 or even 30 seconds or less.

A reversal element is capable of forming a positive image without optical printing. To provide a positive (or reversal) image, the color development step is preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as the Kodak E-6 process. Alternatively, a direct positive emulsion can be employed to obtain a positive image.

The above emulsions are typically sold with instructions to process using the appropriate method such as the mentioned color negative (Kodak C-41), color print (Kodak RA-4), or reversal (Kodak E-6) process.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl) aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride, and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The entire contents of the patent applications, patents and other publications referred to in this specification are incorporated herein by reference.

Synthesis of Coupler

The magenta DIR couplers described in this invention can be prepared by reactions and methods known in the organic chemistry synthesis art. The specific synthesis of inventive compound A2 illustrates the synthesis of these compounds. Ph is phenyl; Et is ethyl; DMF is N,N-dimethyl formamide; THF is tetrahydrofuran; tBu is t-butyl; DCC is dicyclohexylcarbodiimide; DBU is 1,8-diazobicyclo[5.4.0]undec-7-ene

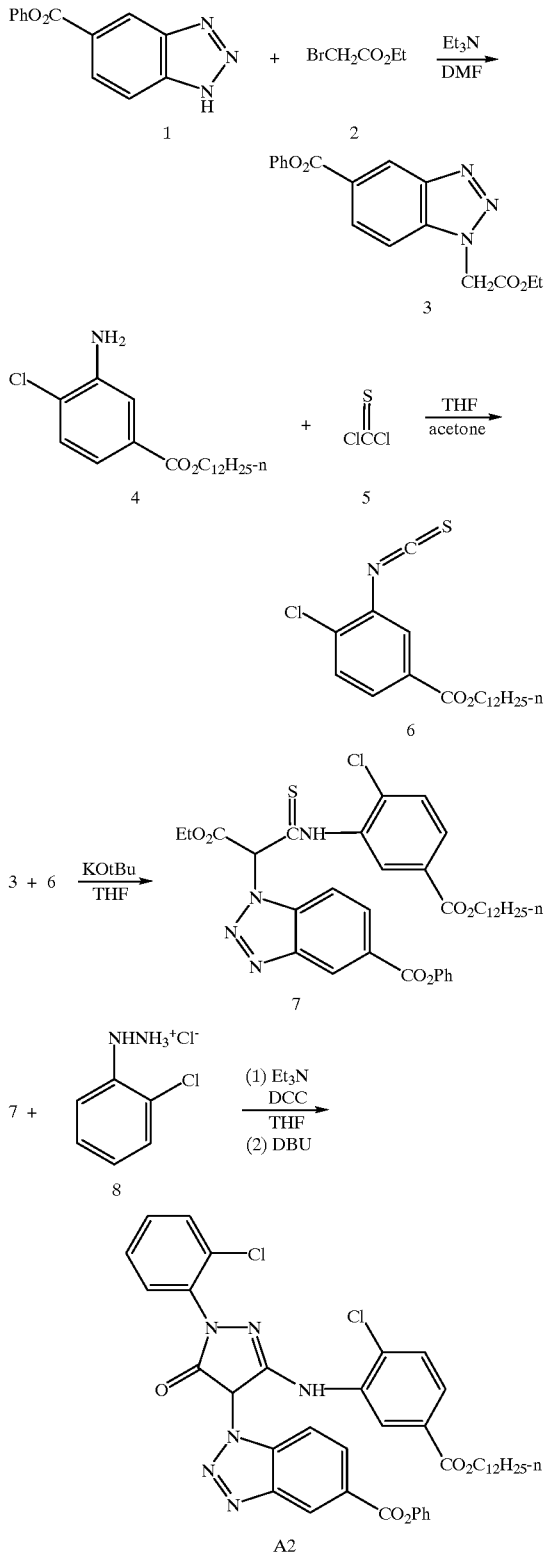

Compound 3

Compound 1 (47.8 g, 0.20 mol) was dissolved in dry DMF (350 mL) at room temperature under a nitrogen atmosphere. Ethyl bromoacetate 2 (33.4 g, 0.20 mol) was added in one portion. The mixture was stirred at room temperature and triethylamine (20.2 g, 0.20 mol) was added dropwise over 20 minutes. The reaction mixture was stirred at room temperature for 2 hours. TLC (silica gel; ethyl acetate/heptane, 40:60) showed 3 product spots at $R_f$ 0.40, 0.45, and 0.50. The reaction mixture was poured with stirring into a mixture of ice and water (800 mL) plus concentrated hydrochloric acid (80 mL). The aqueous mixture was extracted 3 times with ethyl acetate. The extracts were combined and were washed twice with saturated sodium chloride solution. The extracts were dried over magnesium sulfate and were treated with Norit. The mixture was filtered and the solvent was removed on a rotary evaporator. The resulting residue was dissolved in hot methanol (300 mL). The hot solution was allowed to stand at room temperature overnight. The mixture was chilled in ice and then was filtered. The collected solid was washed with cold methanol. The product was dried in a vacuum oven at 40° under nitrogen. This gave compound 3 as white platelets, mp 134–137°. TLC (as above) showed a single spot at Rf 0.40 and an NMR spectrum was consistent with structure 3. Yield 21.9 g (34%).

Compound 6

Compound 4 (37.0 g, 0.109 mol) was mixed with dry acetone (250 mL) and dry THF (75 mL). The mixture was stirred at room temperature under a nitrogen atmosphere, and thiophosgene 5 (13.8 g, 9.1 mL, 0.12 mol) was added in one portion. The mixture was stirred at room temperature for 4 hours. TLC (silica gel; ethyl acetate/heptane, 30:70) showed that some 4 at $R_f$ 0.70 was still present. More 5 (3.0 mL) was added and the mixture was stirred for an additional 19 hours. At this point TLC showed that all 4 had reacted. The reaction mixture was poured with stirring into ice and water (1000 mL). The aqueous mixture was extracted 3 times with ethyl acetate. The extracts were combined and were washed twice with saturated sodium chloride solution. The extracts were dried over magnesium sulfate and then were filtered. The solvent was removed on a rotary evaporator. This gave compound 6 as a tan oil. TLC (as above) showed a major spot at $R_f$ 0.80, trace spot at $R_f$ 0.50. Yield 41.0 g (99%).

Compound 7

Compound 3 (9.8 g, 0.030 mol) and compound 6 (12.2 g, 0.032 mol) were mixed with dry THF (150 mL). The mixture was stirred at room temperature under a nitrogen atmosphere until the reactants dissolved. The reaction flask was chilled in an ice-salt-acetone bath. When the pot temperature was 0°, potassium t-butoxide (3.6 g., 0.032 mol) was added in portions over 5 minutes. The mixture was stirred in the ice bath for 30 minutes more, then it was stirred at room temperature for 2 hours. The reaction mixture was poured into a mixture of ice and water (600 mL) plus concentrated hydrochloric acid (50 mL). The aqueous mixture was extracted 3 times with ethyl acetate. The extracts were combined and were washed twice with saturated sodium chloride solution. The extracts were dried over magnesium sulfate and then were filtered. The solvent was removed from the filtrate on a rotary evaporator to give a tan oil. TLC (silica gel; ethyl acetate/heptane, 40:60) showed a major spot at $R_f$ 0.25, minor spots at $R_f$ 0.80 and 0.40. The crude product was chromatographed over silica gel using ethyl acetate/heptane (40:60) as the eluant. The fractions containing the $R_f$ 0.25 component were combined and the solvent was removed on a rotary evaporator. This gave compound 7 as a tan semi-solid. An NMR spectrum was consistent with the structure of 7. Yield 13.6 g (64%).

Compound A2

Compound 8 (3.2 g, 0.018 mol) was mixed with dry THF (75 mL). The mixture was stirred at room temperature under nitrogen, and triethylamine (1.8 g, 0.018 mol) was added dropwise over 5 minutes. The resulting mixture was stirred at room temperature for 10 minutes. A solution of compound 7 (13.0 g, 0.018 mol) in dry THF (100 mL) was added in one portion. Then a solution of DCC (4.5 g, 0.022 mol) in dry THF (20 mL) was added in one portion. The mixture was stirred at room temperature for 2 and ½ hours. TLC (silica gel; ethyl acetate/heptane, 40:60) showed a major product spot at Rf 0.70 for the arylhydrazone intermediate. A solution of DBU (5.5 g, 0.036 mol) in dry THF (30 mL) was added dropwise over 10 minutes. The mixture was stirred at room temperature for 2 hours. TLC (silica gel; dichloromethane/methanol, 95:5) showed a major product spot at $R_f$ 0.30 (coupled magenta). The reaction mixture was poured with stirring into a mixture of ice and water (600 mL) plus concentrated hydrochloric acid (50 mL). The aqueous mixture was extracted 3 times with ethyl acetate. The extracts were combined and were washed twice with saturated sodium chloride solution. The extracts were dried over magnesium sulfate and then were filtered. Removal of the solvent afforded a tan oil whose TLC (dichloromethane/methanol, 95:5) showed major spots at $R_f$ 0.80 (due to dicyclohexylthiourea) and 0.30, minor spots at $R_f$ 0.95 and 0.50, and several trace spots. The crude product was chromatographed over silica gel using dichloromethane/methanol(95:5) as the eluant. The fractions containing the $R_f$ 0.30 component were combined and the solvent was removed on a rotary evaporator. The resulting residue was stirred in methanol (75 mL) at room temperature for 1 and ½ hours. The mixture was filtered and the collected solid was washed with cold methanol. The product was dried in a vacuum oven at room temperature. This gave compound A2 as a beige powder, mp 100–102°. An NMR spectrum was consistent with the structure of A2. Yield 4.9 g (35%). Anal. Calcd. for $C_{41}H_{42}Cl_2N_6O_5$: C, 63.98; H, 5.50; N, 10.92; Cl, 9.21. Found: C, 63.37; H, 5.66; N, 10.68; Cl, 8.74. HPLC showed that A2 was 93.1% pure.

PHOTOGRAPHIC EXAMPLES

Example 1

The activity of the DIR couplers of this invention relative to comparative DIR couplers may be evaluated by coating the DIR coupler with an imaging coupler in a photographic element containing silver halide. The photographic element may then be exposed and processed, and the amount of remaining DIR and imaging couplers may be analyzed (by extraction and high performance liquid chromatography, hplc) as a function of exposure. A plot of the logarithm of DIR coupler remaining vs the logarithm of the imaging coupler remaining yields a straight line whose slope equals the ratio of the reactivity of the DIR coupler to that of the imaging coupler. It is typically desirable that the reactivity of the DIR coupler be at least twice that of the imaging coupler so that the DIR coupler may effectively compete for oxidized developer and efficiently release inhibitor as a function of exposure. For these comparisons the film format shown in Table I was used and the imaging coupler employed was M-1 having the structure shown below. Similar measurements may be carried out with other imaging couplers such as M-2 or M-3, also shown below. Laydowns in parentheses in Table I are in g/sq m.

TABLE I

| | |
|---|---|
| Overcoat: | Gelatin (5.38) |
| | Bis(vinylsulfonyl)methane Hardener (0.259) |
| M-1 Magenta Imaging Coupler (0.559) & S-1 (0.447) & ST-1 (0.112) | |
| Pyrazolone DIR Coupler Coated at 0.108 mmol/sq m (e.g. 0.085 A2) | |
| Green-Sensitized Silver Iodobromide tabular grain (1.0 × 0.09 μm) (1.61 Ag) | |
| Gelatin (2.69) | |
| Cellulose Acetate Support with Gel U-Coat and Antihalation Backing | |

All DIR couplers were dispersed at a 1:2 weight ratio in tritolyl phosphate (S-1, mixed isomers). Typically, dispersions were prepared by adding an oil phase containing a 1:2:3 weight ratio of DIR coupler: S-1: ethyl acetate to an aqueous phase containing gelatin and the dispersing agent Alkanol XC (Dupont) in a 10:1 weight ratio. The mixture was than passed through a colloid mill to disperse the oil phase in the aqueous phase as small particles. On coating, the ethyl acetate auxiliary solvent evaporates. For couplers C4 and A4 cyclohexanone was used as an auxiliary solvent due to limited solubility in ethyl acetate. Coupler M-1 was coated with S-1 and ST-1 (see below) at a 1:0.8:0.2 weight ratio.

C1

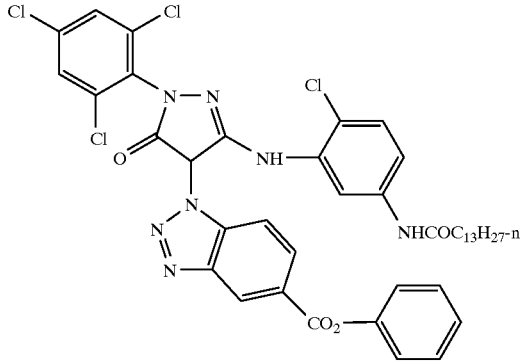

C2

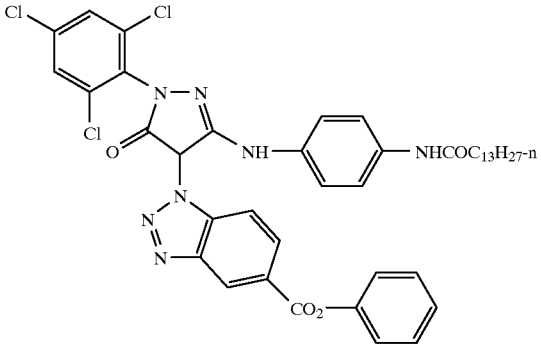

-continued

C3

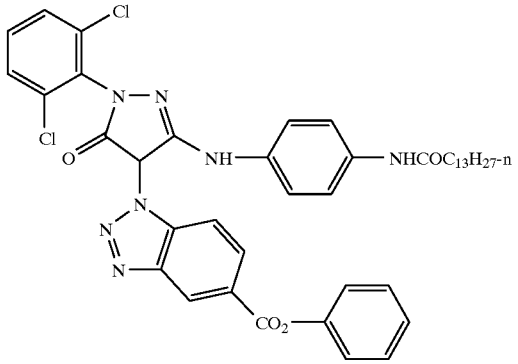

C4

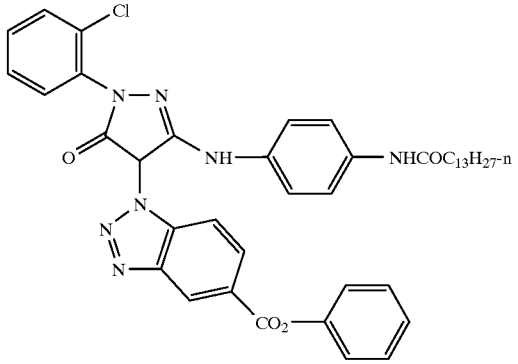

M-1

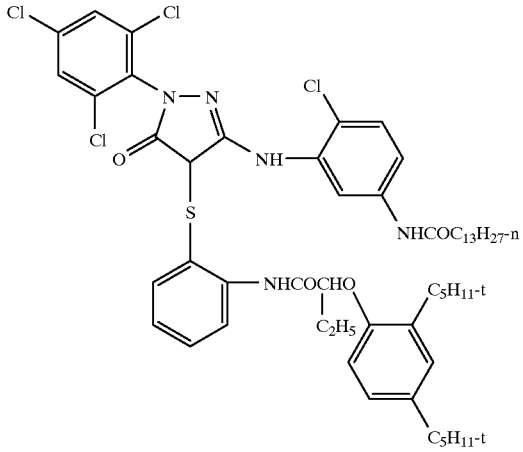

M-2

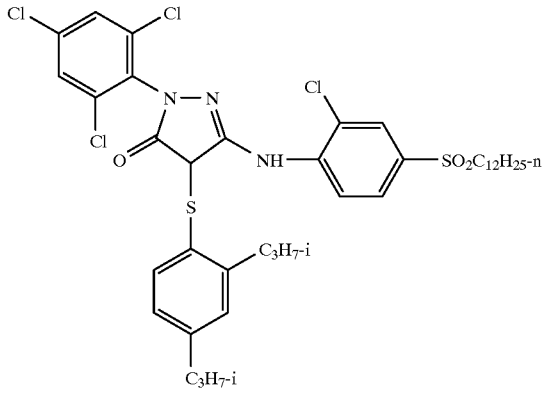

-continued

M-3

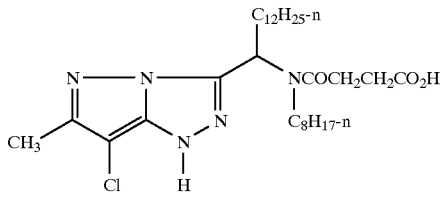

Film samples were exposed and processed in a standard Kodak Flexicolor C-41 process. Extracts of M-1 and DIR coupler from various exposure steps were analyzed by hplc and reactivities of the DIR couplers relative to coupler M-1 were determined as described above. Relative reactivity values for comparative couplers and DIR couplers of this invention are shown in Table II. It is evident from the data in Table II that the DIR couplers of this invention provide desirable high reactivities.

TABLE II

| Pyrazolone DIR Coupler | Reactivity Relative to M-1 |
|---|---|
| C1 (Comparative) | 1.4 |
| C2 (Comparative) | 1.3 |
| C4 (Comparative) | 1.3 |
| A1 (Invention) | 5.7 |
| A2 (Invention) | 2.5 |
| A5 (Invention) | 2.0 |
| A6 (Invention) | 2.0 |
| A8 (Invention) | 5.0 |
| A24 (Invention) | 7.0 |
| A25 (Invention) | 2.7 |

Example 2

Comparative DIR couplers and Pyrazolone DIR couplers of this invention were coated in a format similar to that of Example 1 to assess the stability of the various DIR couplers toward long term storage or storage at elevated temperatures, so-called raw stock keeping. (Couplers C2 and A1 were coated in a bilayer format similar to that of Example 3, but M-1 and DIR laydowns are the same.) Film samples were fixed to remove silver halide. One set was placed in a freezer at −4° C., and the other was incubated at 60° C./50% RH for 2 weeks, an accelerated test designed to simulate long term storage. The film samples were then analyzed for remaining DIR coupler by extraction and hplc. Table III lists the percentages of each coupler lost in the incubated samples, relative to the freezer checks. It is desirable that losses be less than about 15% and preferably less than 10%. The comparative couplers in Table III all show unacceptable stability on storage. The couplers of this invention show acceptable raw stock keeping. In Particular, couplers A1, A5, A6 and A8 show extremely good raw stock stability.

TABLE III

| Pyrazolone DIR Coupler | % Coupler Loss after 2 Weeks at 60° C./50% RH |
|---|---|
| C2 (Comparative) | 25 |
| C3 (Comparative) | 18 |
| C4 (Comparative) | 25 (hand ctg) |
| A1 (Invention) | 2 |
| A2 (Invention) | 14 |
| A4 (Invention) | 12 |
| A5 (Invention) | 4 |
| A6 (Invention) | 4 |
| A8 (Invention) | 8 |
| A24 (Invention) | 7 |
| A25 (Invention) | 9 |

Example 3

To illustrate the superior silver development inhibition and interimage provided by the pyrazolone DIR couplers of this invention, they were also evaluated in the multilayer causer/receiver format shown in Table IV. Structures of components not given previously or in Example 4 are provided after Table IV. Laydowns in parenthesis in Table IV are in g/m$^2$.

Film samples were given a sensitometric white light (neutral) exposure and processed in a standard Kodak Flexicolor C-41 process. Green (causer) and red (receiver) status M densities vs exposure were then measured for film A without DIR coupler, film B with comparative DIR coupler C2 and film C containing DIR coupler A1 of this invention. Both C2 and A1 were coated at a level of 0.161 micro moles/sq ft. Green and red gamma values were then obtained from slopes of the plots of density vs log exposure. For high interlayer interimage and high color correction it is desirable that a DIR coupler provide minimal reduction in gamma in its own layer (causer gamma), but substantial gamma reduction in receiver layers. In this case green gamma corresponds to causer gamma and red gamma to receiver gamma. For uninhibited film A, green and red gammas are 1.00 and 0.99, respectively. For film B with comparative coupler C2, green and red gammas are reduced to 0.90 and 0.86, respectively. For film C with coupler A1 of this invention, green and red gammas are reduced to 0.88 and 0.65 respectively. Thus, while both couplers C2 and A1 produce small reductions in green causer gamma, coupler A1 provides a much larger and desirable reduction (34%) in red receiver gamma than does C2 (13%).

TABLE IV

| | |
|---|---|
| OVERCOAT: | Gelatin (2.69) |
| | Bis(vinylsulfonyl)methane Hardener (0.227) |
| CAUSER: | M-1 (0.43) & S-1 (0.344) & ST-1 (0.086) |
| A) | No DIR Coupler (Uninhibited Check) |
| B) | C2 (0.141) & S-1 (0.282) Comparative |
| or C) | A1 (0.142) & S-1 (0.284) Invention |
| | Green-Sens. Silver Iodobromide tabular grain emulsion (0.807 Ag) |
| | Gelatin (2.69) |

TABLE IV-continued

| | |
|---|---|
| INTERLAYER: | IS-1 (0.054) & S-1 (0.054) |
| | Gelatin (0.86) |
| RECEIVER: | CC-1 (0.753) & S-2 (0.753) |
| | B-2 (0.054) & S-3 (0.054) |
| | IR-5 (0.022) & S-5 (0.044) |
| | Red-Sens. Silver Iodobromide tabular grain emulsion (0.807 Ag) |
| | Gelatin (2.69) |
| Cellulose Acetate Support with Gel U-Coat and Antihilation Backing | |

IS-1

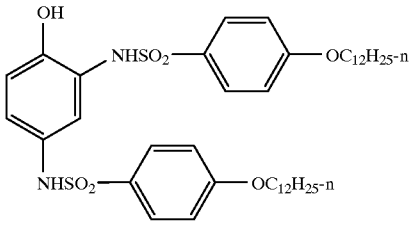

IR-5

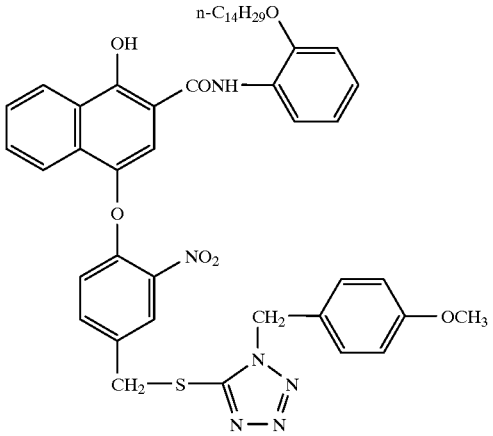

-continued

B-2

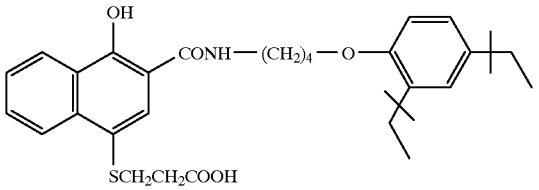

Example 4

The multilayer film structure utilized for this example is shown schematically in Table V. Structures of components not provided previously are given immediately following Table V. Component laydowns are provided in units of g/sq m unless otherwise indicated. Gelatin is used as a binder in the various layers of the multilayer film. A similar composition may be coated on a support, such as polyethylene naphthalate, containing a magnetic recording layer. This film may be processed using Kodak Flexicolor C-41 chemistry to yield improved interimage and color.

TABLE V

| MULTILAYER FILM STRUCTURE | |
|---|---|
| 1 Overcoat Layer: | Matte Beads |
| | Gelatin (0.89) |
| 2 UV Protective Layer | UV Absorber UV-1 (0.111) & S-4 (0.111) |
| | UV Absorber UV-2 (0.111) & S-4 (0.111) |
| | Silver Bromide Lippmann Emulsion (0.215 Ag) |
| | Gelatin (0.70) |
| 3 Fast Yellow Layer: | Y-1 (0.150) Yellow Dye-Forming Coupler & S-1 (0.075) |
| | IR-1 (0.032) DIR Coupler & S-1 (0.016) |
| | B-1 (0.0054) BARC & S-3 (0.0070) |
| Blue Sensitive Silver Iodobromide Emulsion (0.435 Ag), | |
| | 4.5 mole % Iodide tabular grain (2.3 × 0.13 μm) |
| | Gelatin (0.753) |
| 4 Slow Yellow Layer: | Y-1 (0.915) & S-1 (0.457) |
| | IR-1 (0.032) & S-1 (0.016) |
| | B-1 (0.0065) & S-3 (0.0084) |
| Blue Sensitive Silver Iodobromide Emulsion (0.180 Ag), | |
| | 4.5 mole % Iodide tabular grain (1.4 × 0.13 μm) |
| Blue Sensitive Silver Iodobromide Emulsion (0.120 Ag), | |
| | 1.5 mole % Iodide tabular grain (0.85 × 0.13 μm) |
| Blue Sensitive Silver Iodobromide Emulsion (0.180 Ag) | |
| | 1.3 mole % Iodide tabular grain (0.54 × 0.09 μm) |
| | Gelatin (1.668) |
| | Bis(vinylsulfonyl)methane Hardener at 2.1% |
| | by weight of total Gelatin |
| 5 Yellow Filter | R-1 (0.075) & S-2 (0.121) & ST-2 (0.010) |

TABLE V-continued

| MULTILAYER FILM STRUCTURE | |
|---|---|
| Layer: | Gelatin (0.861) |
| | YD-1 (0.097) & YD-2 Filter Dye (0.108) |
| 6 Fast Magenta | M-1(0.050) Magenta Dye-Forming Coupler & S-1 (0.045) |
| Layer: | & ST-1 (0.005) Addendum |
| | MM-1 (0.025) Masking Coupler & S-1 (0.050) |
| | A1 (0.027) DIR Coupler & S-1 (0.054) |
| Green Sensitive Silver Iodobromide Emulsion (0.699 Ag), | |
| | 4.5 mole % Iodide tabular grain (0.98 × 0.11 μm) |
| | Gelatin (1.22) |
| 7 Mid Magenta | M-1 (0.120) & S-1 (0.108) & ST-1 (0.012) |
| Layer: | MM-1 (0.030) & S-1 (0.060) |
| | A1 (0.031) DIR Coupler & S-1 (0.062) |
| Green Sensitive Silver Iodobromide Emulsion (0.646 Ag), | |
| | 4.5 mole % Iodide tabular grain (0.61 × 0.12 μm) |
| | Gelatin (1.41) |
| 8 Slow Magenta | M-1 (0.170) & S-1 (0.153) & ST-1 (0.017) |
| Layer: | MM-1 (0.036) & S-1 (0.072) |
| Green Sensitive Silver Iodobromide Emulsion (0.377 Ag), | |
| | 3.3 mole % Iodide Cubic (0.275 μm) |
| Green Sensitive Silver Iodobromide Emulsion (0.108 Ag), | |
| | 1.3 mole % Iodide tabular grain (0.54 × 0.09 μm) |
| | Gelatin (1.18) |
| 9 Interlayer: | R-1 (0.075) Interlayer Scavenger & S-6 (0.113) |
| | Gelatin (0.86) |
| 10 Fast Cyan | CC-1 (0.180) Cyan Dye-Forming Coupler & S-2 (0.180) |
| Layer: | CM-1 (0.032) Masking Coupler |
| | IR-3 (0.038) DIAR Coupler & S-5 (0.076) |
| | IR-4 (0.038) DIAR Coupler & S-2 (0.076) |
| Red Sensitive Silver Iodobromide Emulsion (0.988 Ag), | |
| | 4.5 mole % Iodide tabular grain (1.10 × 0.11 μm) |
| | Gelatin (1.45) |
| 11 Mid Cyan | CC-1 (0.190) & S-2 (0.190) |
| Layer: | CM-1 (0.011) |
| | B-1 (0.027) & S-3 (0.035) |
| | IR-3 (0.054) & S-5 (0.108) |
| Red Sensitive Silver Iodobromide Emulsion (0.225 Ag), | |
| | 4.5 mole % Iodide tabular grain (0.98 × 0.11 μm) |
| Red Sensitive Silver Iodobromide Emulsion (0.870 Ag), | |
| | 3.3 mole % Iodide Cubic (0.49 μm) |
| | Gelatin (1.35) |
| 12 Slow Cyan | CC-1 (0.390) & S-2 (0.390) |
| Layer: | IR-4 (0.011) & S-2 (0.022) |
| | B-1 (0.075) & S-3 (0.098) |
| Red Sensitive Silver Iodobromide Emulsion (0.390 Ag), | |
| | 3.3 mole % Iodide Cubic (0.32 μm) |
| | Gelatin (1.64) |
| 13 Interlayer: | R-1 (0.075) & S-6 (0.113) |
| | Gelatin (0.86) |
| 14 Antihalation | Grey Silver (0.15 Ag), CD-1 (0.0161), MD-1 (0.043) |
| Layer: | UV-1 (0.0753), S-4 (0.0753), S-1 |
| | Gelatin (1.61) |
| | YD-3 (0.028) and S-1 (0.056) |
| Cellulose Triacetate Support | |

S-1

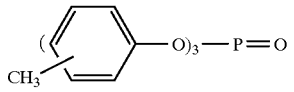

mixed isomers

S-2

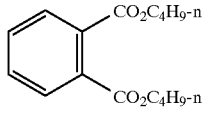

S-3

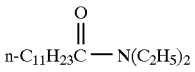

-continued
S-4
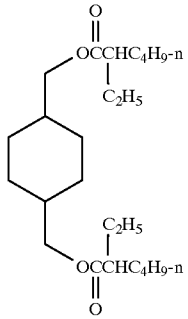
S-5
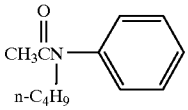
S-6
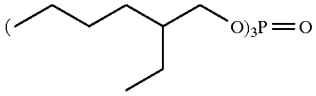
UV-1
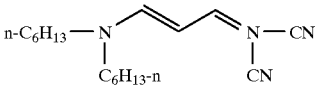
UV-2
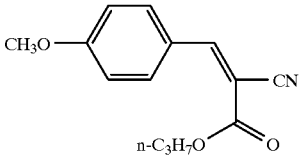
Y-1
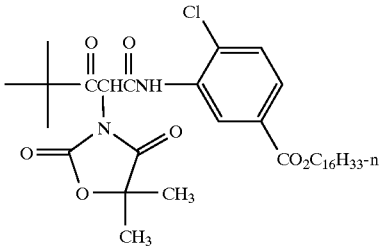
IR-1
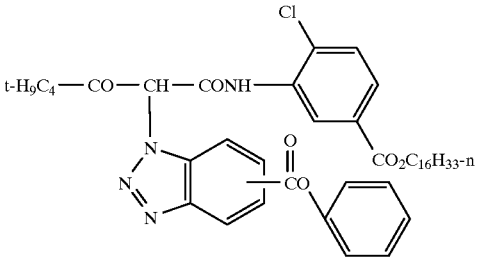

-continued
YD-2
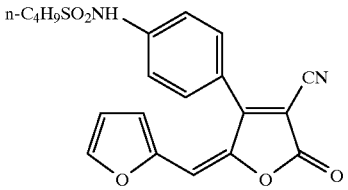
ST-1
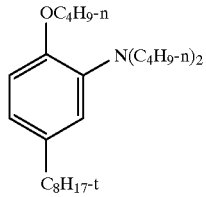
R-1
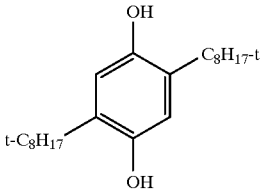
ST-2
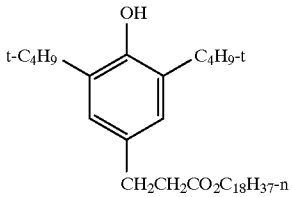
M-1
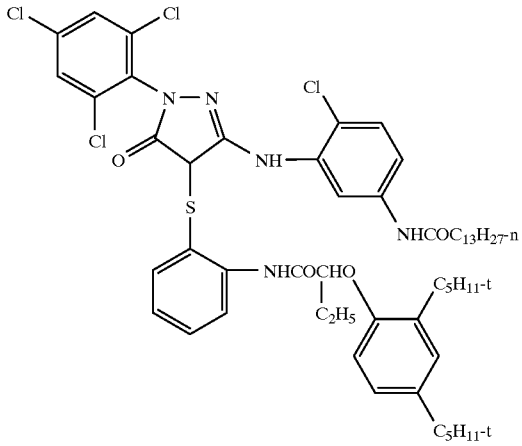

-continued
MM-1
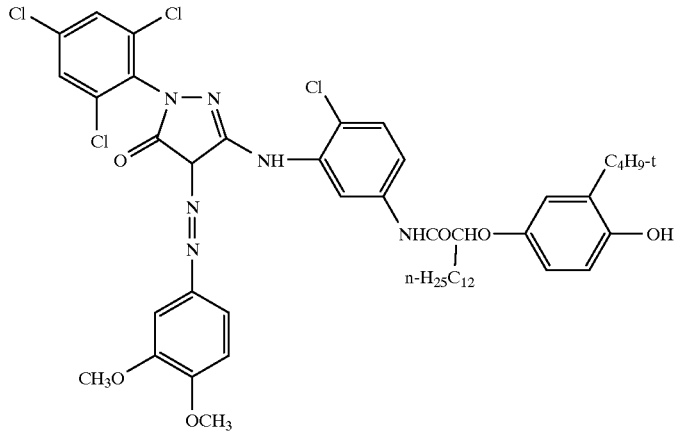
CC-1
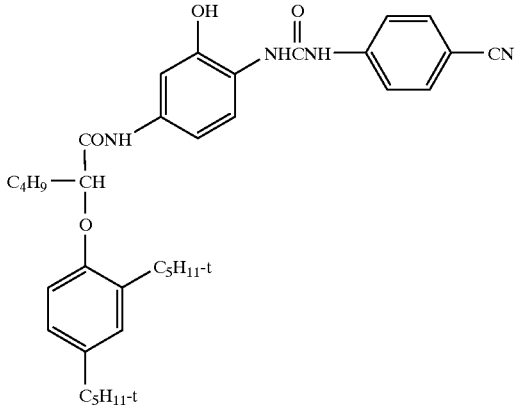
CM-1
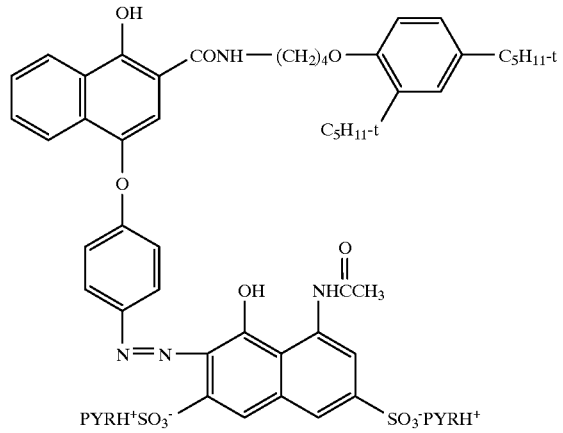
YD-3
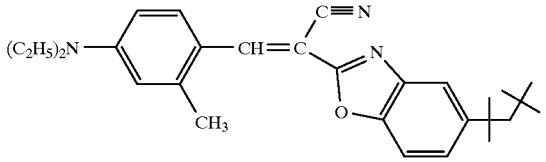

-continued
IR-3
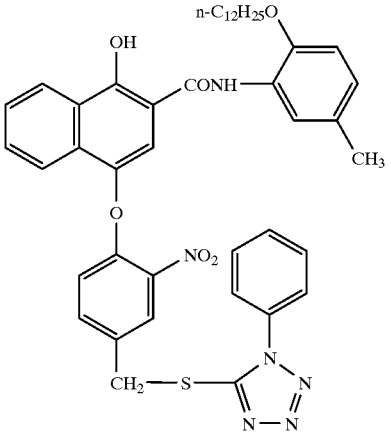
IR-4
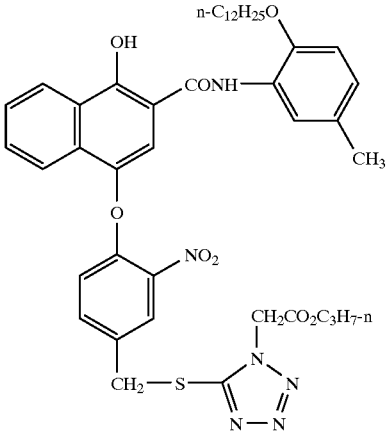
B-1
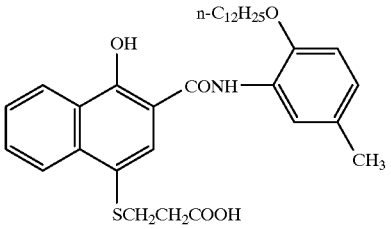
CD-1
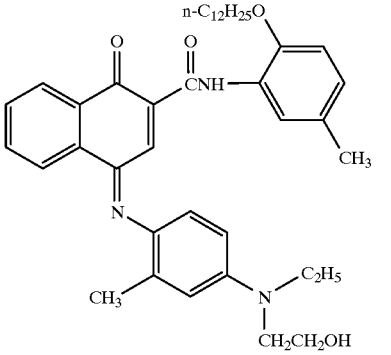

-continued

MD-1

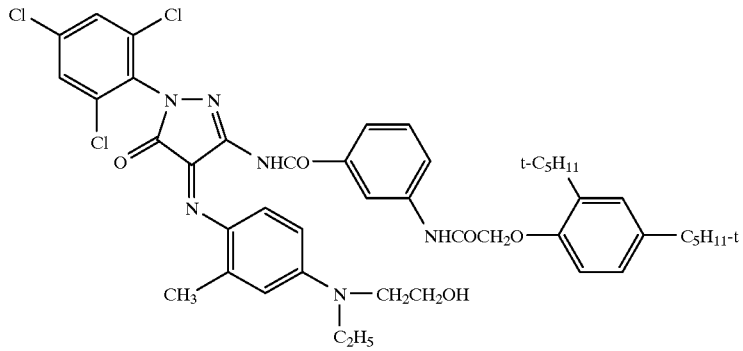

YD-1

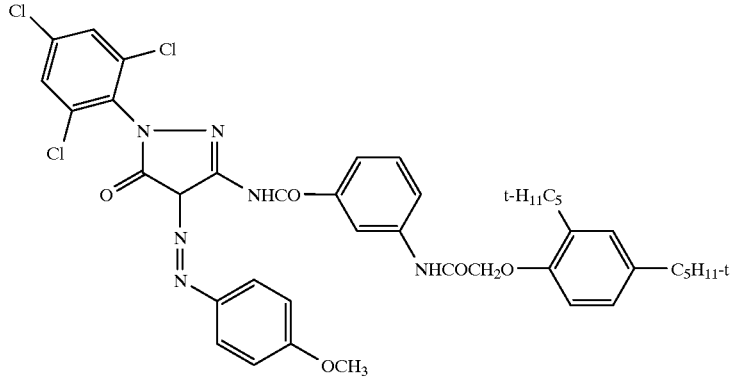

What is claimed is:

1. A photographic element comprising a silver halide emulsion layer having associated therewith a 1-phenyl-3-anilino-4-benzotriazolyl-5-pyrazolone magenta dye-forming DIR coupler of structure I:

I

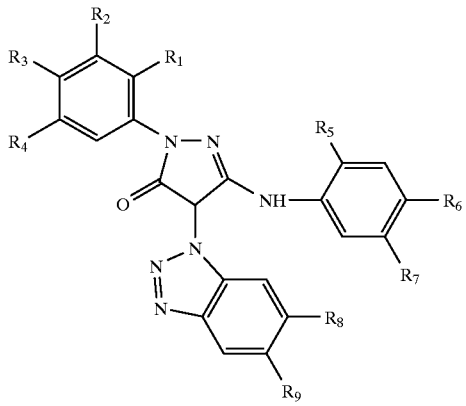

wherein:

$R_1$ is hydrogen, chlorine, fluorine or a methyl group;

$R_2$, $R_3$, and $R_4$ are individually selected from the group consisting of hydrogen, halogen, alkyl, phenyl, alkoxy, phenoxy, alkylthio, carbonamido, sulfonamido, carbamoyl, alkoxycarbonyl and aryloxycarbonyl groups;

$R_5$ is hydrogen, bromine, chlorine, fluorine, or an alkyl group;

$R_6$ and $R_7$ are independently selected from the group consisting of hydrogen, halogen, carbonamido, carbamoyl, sulfonamido, sulfamoyl, alkylsulfonyl, arylsulfonyl, alkylsulfoxyl, arylsulfoxyl, sulfonyloxy, alkoxycarbonyl, aryloxycarbonyl, acyloxy, acyl, imido, trifluoromethyl and cyano groups, provided that at least one of $R_6$ and $R_7$ is not hydrogen;

$R_8$ and $R_9$ are independently selected from the group consisting of hydrogen, halogen, alkyl, phenyl, alkoxy, phenoxy, alkoxycarbonyl, aryloxycarbonyl, carbonamido, sulfonamido, carbamoyl and carbamoyloxy groups, provided that at least one of $R_8$ and $R_9$ is not hydrogen;

further provided that (1) when $R_5$ is hydrogen, the sum of the Hammett's sigma values of $R_6$ and $R_7$, referenced to the position of the anilino nitrogen, is at least 0.30, and $R_1$ is also hydrogen, and (2) when $R_5$ is bromine, chlorine, fluorine, or an alkyl group, the sum of the Hammett sigma values of $R_6$ and $R_7$, referenced to the position of the anilino nitrogen, is a least 0.20; and the sum of pi values of $R_8$ and $R_9$ taken together is at least 0.60 but not more than 3.00.

2. A photographic element according to claim 1, wherein $R_1$ is hydrogen.

3. A photographic element according to claim 1, wherein $R_5$ is chlorine or fluorine.

4. A photographic element according to claim 3, wherein the sum of the sigma values of $R_6$ and $R_7$ taken together is at least 0.25.

5. A photographic element according to claim 1, wherein $R_1$, $R_2$, and $R_4$ are hydrogen and $R_3$ is hydrogen or a methyl group.

6. A photographic element according to claim 1, wherein the sum of the pi values of $R_8$ and $R_9$ is from 1.0 to 2.2.

7. A photographic element according to claim 1, wherein at least one of $R_8$ and $R_9$ is a readily hydrolyzable group.

8. A photographic element according to claim 7, wherein at least one of $R_8$ and $R_9$ is a phenoxycarbonyl group or a —$CO_2CH_2CO_2R_{10}$ group, wherein $R_{10}$ is an alkyl or phenyl group.

9. A photographic element according to claim 1 wherein the total number of halogen plus carbon atoms in $R_1$–$R_7$ taken together is at least 8.

10. A photographic element according to claim 1, wherein the coated level of DIR coupler of structure I is between 0.005 and 0.40 g/sq m.

11. A photographic element according to claim 1, wherein $R_5$ is chlorine, $R_6$ is 4—$SO_2C_{12}H_{25}$ and $R_7$ is hydrogen.

12. A photographic element according to claim 1, wherein the DIR coupler is selected from the following:

A1

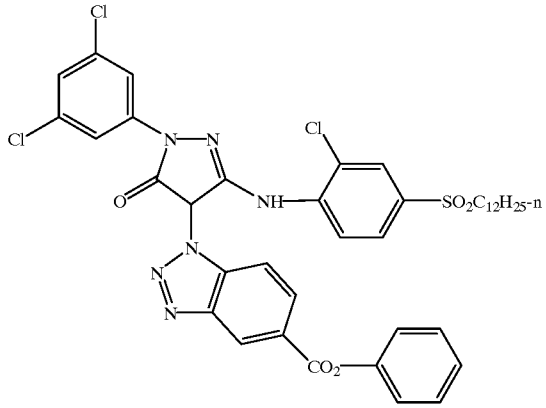

A2

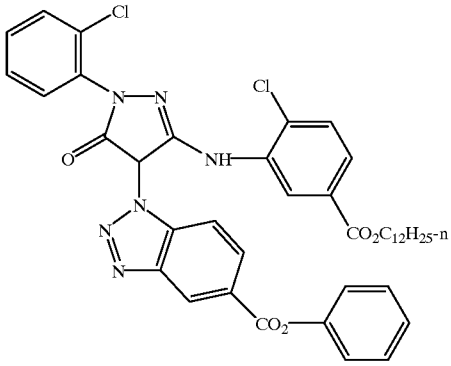

A4

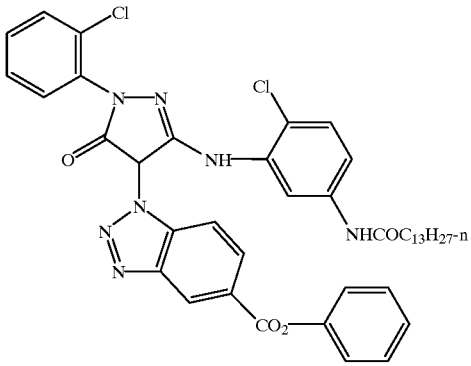

-continued

A5

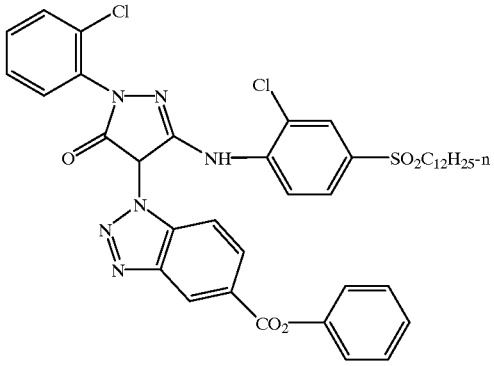

A6

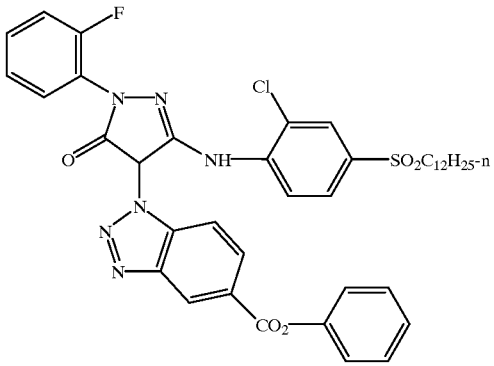

A7

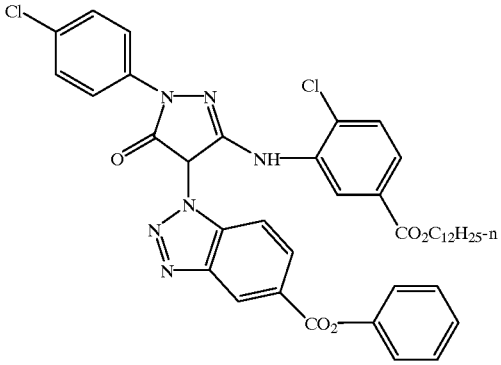

A8

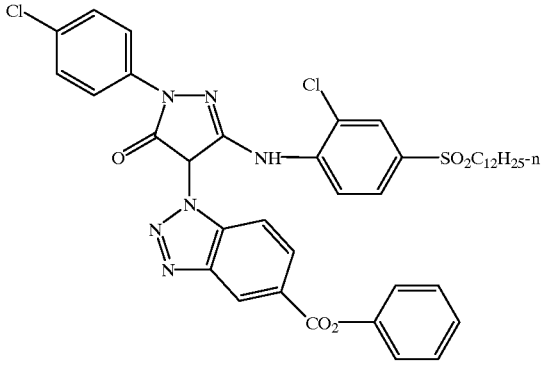

-continued

A23

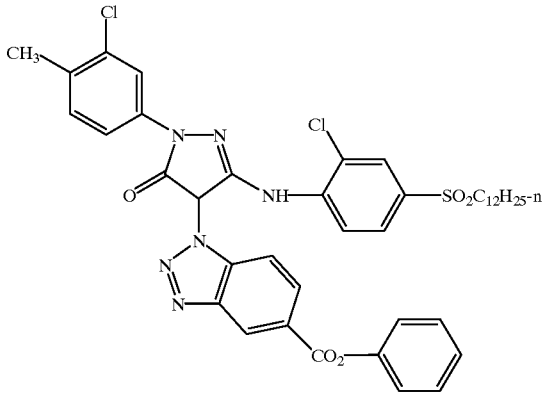

A24

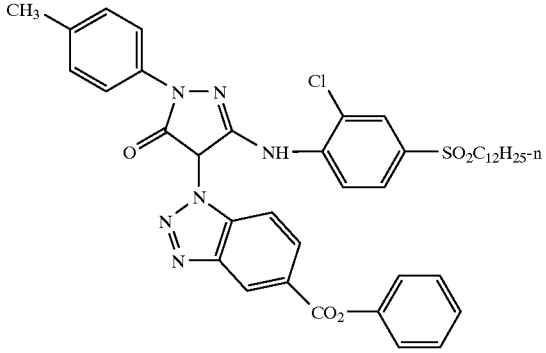

A25

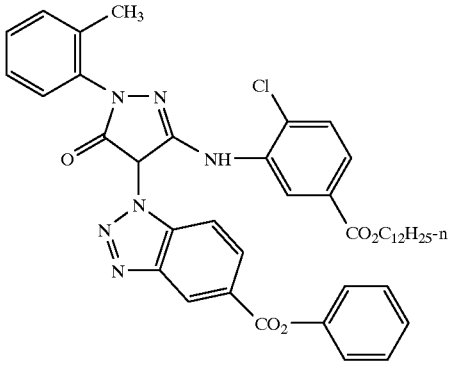

A26

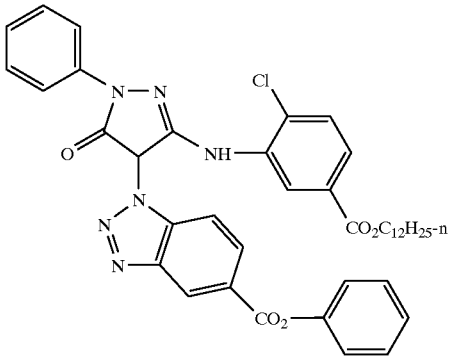

-continued

A27

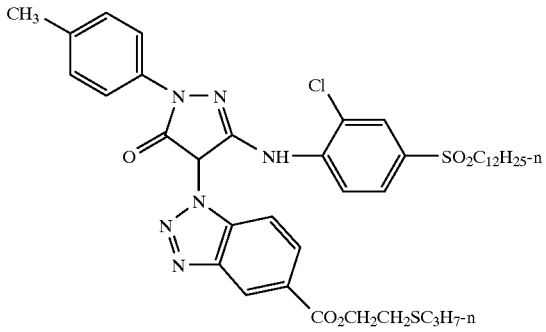

A28

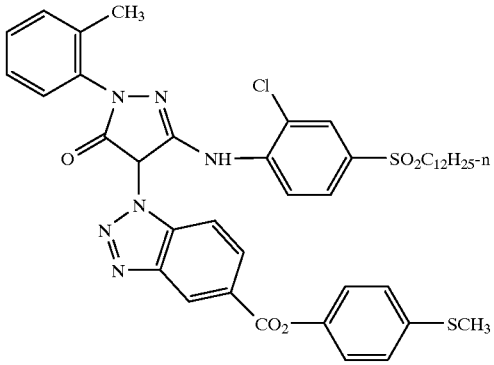

and

A29

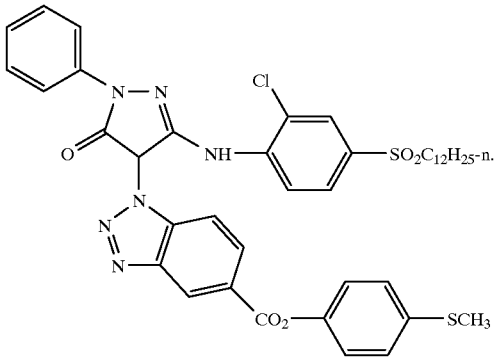

13. A photographic element according to claim 1 said silver halide emulsion layer additionally having associated therewith a 1-phenyl-3-anilino-5-pyrazolone magenta dye-forming imaging coupler of the formula:

(I)

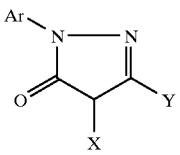

wherein:

Ar is selected from the group consisting of unsubstituted aryl groups, substituted aryl groups and substituted pyridyl groups, the substituents being selected from the group consisting of halogen atoms and cyano, alkylsulfonyl, arylsulfonyl, sulfamoyl, sulfonamido, carbamoyl, carbonamido, alkoxy, acyloxy, aryloxy, alkoxycarbonyl, aryloxycarbonyl, ureido, nitro, alkyl and trifluoromethyl groups;

Y is selected from the group consisting of anilino, acylamino and ureido groups and one of said groups substituted with one or more substituents selected from the group consisting of halogen atoms, and alkyl, aryl, alkoxy, aryloxy, carbonamido, carbamoyl, sulfonamido, sulfamoyl, alkylsulfoxyl, arylsulfoxyl, alkylsulfonyl, arylsulfonyl, alkoxycarbonyl, aryloxycarbonyl, acyl, acyloxy, ureido, imido, carbamate, heterocyclic, cyano, trifluoromethyl, alkylthio, nitro, carboxyl and hydroxyl groups, and groups which form a link to a polymeric chain, and wherein Y contains at least 6 carbon atoms; and X is a coupling-off group selected from the group consisting of halogen atoms, and alkoxy, aryloxy, alkylthio, arylthio, acyloxy, sulfonamido, sulfonyloxy, carbonamido, arylazo, nitrogen-containing heterocyclic and imido groups.

14. A photographic element according to claim 13, wherein Y has the formula:

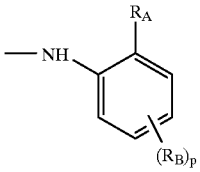

wherein p is from zero to 2 and each $R_B$ is in a meta or para position with respect to $R_A$;

each $R_B$ is individually selected from the group consisting of halogen atoms and alkyl, alkoxy, aryloxy, carbonamido, carbamoyl, sulfonamido, sulfamoyl, alkylsulfoxyl, arylsulfoxyl, alkylsulfonyl, arylsulfonyl, alkoxycarbonyl, aryloxycarbonyl, acyloxy, ureido, imido, carbamate, heterocyclic, cyano, nitro, acyl, trifluoromethyl, alkylthio and carboxyl groups, and;

$R_A$ is selected from the group consisting of hydrogen, halogen atoms and alkyl, alkoxy, aryloxy, alkylthio, carbonamido, carbamoyl, sulfonamido, sulfamoyl, alkylsulfonyl, arylsulfonyl, alkoxycarbonyl, acyloxy, acyl, cyano, nitro and trifluoromethyl groups.

15. A photographic element according to claim 14, wherein X the formula:

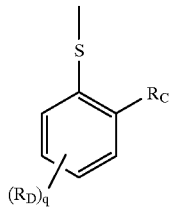

wherein $R_C$ and $R_D$ are individually selected from the group consisting of hydrogen, halogen atoms and alkyl, alkoxy, aryloxy, carbonamido, ureido, carbamate, sulfonamido, carbamoyl, sulfamoyl, acyloxy, alkoxycarbonyl, aryloxycarbonyl, amino and carboxyl groups; and wherein q is 0, 1 or 2 and $R_D$ may be in the meta or para position with respect to the sulfur atom.

16. A photographic element according to claim 15, wherein the magenta dye-forming imaging coupler is selected from the following:

M-1

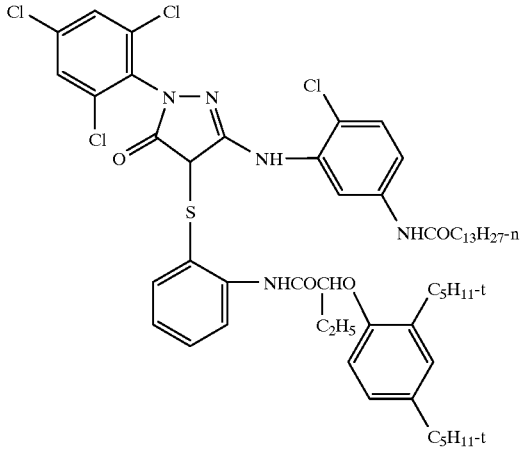

and

M-2

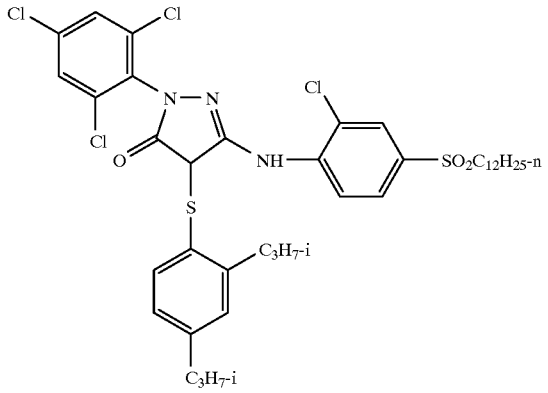

* * * * *